US008187152B2

(12) United States Patent
Gravel et al.

(10) Patent No.: US 8,187,152 B2
(45) Date of Patent: May 29, 2012

(54) REHABILITATION SYSTEM AND METHOD USING MUSCLE FEEDBACK

(75) Inventors: Martin Gravel, Chicoutimi (CA); Laval Desbiens, Jonquière (CA)

(73) Assignee: Consultant en Ergonomie et en Mieux-Etre du Saguenay Inc., Chicoutimi, QC (CA)

( * ) Notice: Subject to any disclaimer, the term of this patent is extended or adjusted under 35 U.S.C. 154(b) by 89 days.

(21) Appl. No.: 12/884,314

(22) Filed: Sep. 17, 2010

(65) Prior Publication Data

US 2011/0071002 A1 Mar. 24, 2011

Related U.S. Application Data

(60) Provisional application No. 61/243,736, filed on Sep. 18, 2009.

(51) Int. Cl.
*A63B 71/00* (2006.01)

(52) U.S. Cl. ..... 482/7; 482/1; 482/8; 482/901

(58) Field of Classification Search ..... 482/1–9, 482/900–902; 434/247; 73/379.01–379.03
See application file for complete search history.

(56) References Cited

U.S. PATENT DOCUMENTS

| | | | | |
|---|---|---|---|---|
| 4,627,620 | A * | 12/1986 | Yang | 273/446 |
| 4,711,450 | A | 12/1987 | McArthur | |
| 4,732,381 | A | 3/1988 | Skowronski | |
| 4,944,508 | A | 7/1990 | Collins | |
| 5,080,350 | A | 1/1992 | Schofield et al. | |
| 5,348,519 | A | 9/1994 | Prince et al. | |
| 5,429,140 | A | 7/1995 | Burdea et al. | |
| 5,454,773 | A | 10/1995 | Blanchard et al. | |
| 5,460,585 | A | 10/1995 | Gentry et al. | |
| 5,551,950 | A | 9/1996 | Oppen | |
| 5,711,746 | A | 1/1998 | Carlson | |
| 5,722,420 | A | 3/1998 | Lee | |
| 5,813,951 | A | 9/1998 | Einsig | |
| 6,379,393 | B1 | 4/2002 | Mavroidis et al. | |
| 6,413,190 | B1 | 7/2002 | Wood et al. | |
| 6,436,058 | B1 | 8/2002 | Krahner et al. | |
| 6,515,593 | B1 | 2/2003 | Stark et al. | |
| 6,569,067 | B1 | 5/2003 | Madole | |
| 6,827,670 | B1 | 12/2004 | Stark et al. | |
| 6,872,187 | B1 | 3/2005 | Stark et al. | |
| 7,172,537 | B2 | 2/2007 | Eisa | |

(Continued)

FOREIGN PATENT DOCUMENTS

| | | |
|---|---|---|
| EP | 0603135 | 6/1994 |

(Continued)

*Primary Examiner* — Glenn Richman
(74) *Attorney, Agent, or Firm* — Fasken Martineau

(57) ABSTRACT

There is provided a machine for rehabilitation or exercise, comprising: a frame; a first arm movably secured to the frame via a first actuator; a first force sensor for measuring a force exerted by a user on the first arm; and a control unit adapted for controlling a displacement speed for the first arm via the first actuator as a function of the force and for increasing the displacement speed of the first arm via the first actuator when the force is superior to a target force. In one embodiment, there is further provided an electromyograph for location on the exercised muscle for measuring an electrical potential generated by the muscle and for lowering the target force when the electrical potential is superior to a predetermined maximum electrical potential. There is further provided a method for operating an exercise machine and a system for exercising a muscle.

9 Claims, 14 Drawing Sheets

U.S. PATENT DOCUMENTS

| | | | | |
|---|---|---|---|---|
| 7,190,141 | B1 | 3/2007 | Ashrafiuon et al. | |
| 7,204,814 | B2 | 4/2007 | Peles | |
| 7,416,537 | B1 | 8/2008 | Stark et al. | |
| 7,674,206 | B2 * | 3/2010 | Jones | 482/54 |
| 7,789,801 | B2 * | 9/2010 | Stearns et al. | 482/8 |
| 8,012,107 | B2 * | 9/2011 | Einav et al. | 601/5 |
| 2005/0101887 | A1 | 5/2005 | Stark et al. | |
| 2005/0113652 | A1 | 5/2005 | Stark et al. | |
| 2006/0277074 | A1 | 12/2006 | Einav et al. | |
| 2007/0225620 | A1 | 9/2007 | Carignan et al. | |
| 2007/0282228 | A1 | 12/2007 | Einav et al. | |
| 2008/0004550 | A1 | 1/2008 | Einav et al. | |
| 2008/0234113 | A1 | 9/2008 | Einav | |
| 2008/0242521 | A1 | 10/2008 | Einav | |
| 2008/0300511 | A1 | 12/2008 | Binns et al. | |
| 2009/0075791 | A1 | 3/2009 | Kissel et al. | |
| 2009/0131225 | A1 | 5/2009 | Burdea et al. | |
| 2009/0140683 | A1 | 6/2009 | Chang et al. | |
| 2010/0113222 | A1 * | 5/2010 | Radow | 482/5 |

FOREIGN PATENT DOCUMENTS

| | | |
|---|---|---|
| WO | 2004107085 | 12/2004 |

* cited by examiner

REHABILITATION SYSTEM AND METHOD USING MUSCLE FEEDBACK

CROSS-REFERENCE TO RELATED APPLICATIONS

This application claims the benefit of U.S. Provisional Application Ser. No. 61/243,736, filed Sep. 18, 2009 and entitled REHABILITATION AND/OR EXERCISE MACHINE, the specification of which is incorporated herein by reference.

TECHNICAL FIELD

The present invention relates to the field of rehabilitation and/or exercise systems, and specifically to rehabilitation and/or exercise systems and methods using muscle feedback.

BACKGROUND

In order to treat disorders and/or injuries of the musculoskeletal system, rehabilitation or physical therapy is usually needed. The injured person has to exercise the injured member. However, if the exercising is not controlled adequately, the person may worsen the injury. For example, if a person has an injured shoulder, lifting weights may treat the injured shoulder. However, if the weight of the charge is too heavy, the injury may worsen.

Therefore, there is a need for an improved method and apparatus for rehabilitation of an injured organ or prevention of any injury.

SUMMARY

In accordance with a first broad aspect, there is provided a machine for at least one of rehabilitation and exercise, comprising: a frame; a first arm movably secured to the frame; a first actuator operatively connected to the first arm for displacing the first arm with respect to the frame; a first force sensor for measuring a force exerted by a user on the first arm; and a control unit operatively connected to the first actuator and the first force sensor, the control unit being adapted for controlling a displacement speed for the first arm via the first actuator as a function of the force and for increasing the displacement speed of the first arm via the first actuator when the force is superior to a target force.

In one embodiment, the control unit is adapted to decrease the displacement speed of the first arm via the first actuator when the force is inferior to a minimum limit.

In one embodiment, the machine further comprises an electrical potential sensor operatively connected to the control unit for measuring an electrical potential generated by a muscle of the user while the user is exerting the force on the first arm, the control unit being adapted for lowering the target force when the electrical potential is superior to a predetermined maximum electrical potential.

In one embodiment, the control unit is adapted to allow an initial displacement for the first arm only when the force is at least equal to a predetermined force threshold.

In one embodiment, the machine further comprises: a second arm movably secured to the frame; a second actuator operatively connected to the second arm for displacing the second arm with respect to the frame; and a second force sensor for measuring a force exerted by a user on the second arm, the control unit being further operatively connected to the second actuator and the second force sensor.

In one embodiment, the first actuator comprises a first motor rotatably connecting the first arm to the frame and the second actuator comprises a second motor rotatably connecting the second arm to the frame, the first motor defining a first rotation axis and the second motor defining a second rotation axis.

In one embodiment, the first and second arms are spaced apart and the machine comprises a seat positioned between the first and second arms to allow the user to hold and exert the force on both the first and second arms while sitting on the seat.

In one embodiment, the first and second arms are movable to a coronal exercise position wherein the first and second rotation axes are aligned, the first and second arms being positioned so as to allow a user to selectively perform extension and flexion movements using the first and second arms while sitting on the seat.

In one embodiment, the first and second arms are movable to a sagittal exercise position wherein the first and second rotation axes are parallel and spaced apart, the first and second arms being positioned so as to allow a user to selectively perform abduction and adduction movements using the first and second arms while sitting on the seat.

In accordance with another broad aspect, there is provided a method for operating an exercise machine, the method comprising: measuring a force exerted by a user on an arm movably secured to a frame of the exercise machine via an actuator; comparing the force to a maximum limit; when the force is inferior or equal to a target force, determining a displacement speed for the arm in accordance with the force; moving the arm in accordance with the displacement speed; and when the force is superior to the target force, increasing the displacement speed of the arm via the actuator.

In one embodiment, the method further comprises: measuring an electrical potential generated by a muscle of the user while the user is moving the arm; and when the electrical potential is superior to a maximum allowable electrical potential, decreasing the target force.

In one embodiment, the method comprises, before measuring the force exerted by the user on the arm: measuring a maximum electrical potential generated by the muscle of the user; and calculating the maximum allowable electrical potential according to the maximum electrical potential.

In one embodiment, measuring the maximum electrical potential comprises: blocking the arm so as to prevent movement thereof; and measuring the electrical potential generated by the muscle when the user exerts a maximum amount of force against the arm.

In one embodiment, decreasing the target force comprises: calculating a potential difference between the electrical potential generated by a muscle of the user and the maximum allowable electrical potential; calculating a potential difference ratio of the potential difference with respect to the maximum allowable electrical potential; applying the potential difference ratio to the target force to obtain a force correction value; and subtracting the target force by the force correction value.

In one embodiment, determining a displacement speed for the arm comprises: measuring an actual displacement speed; calculating a force difference between the force exerted by the user on the arm and the target force; applying a predetermined correction coefficient to the force difference to obtain a correction value; and subtracting the correction value from the actual displacement speed to obtain a corrected displacement speed.

In one embodiment, increasing the displacement speed of the arm comprises: measuring an actual displacement speed;

calculating a force difference between the force exerted by the user on the arm and the target force; applying a predetermined correction coefficient to the force difference to obtain a correction value; and adding the correction value to the actual displacement speed to obtain a corrected displacement speed.

In one embodiment, the method further comprises allowing for an initial displacement for the arm only when the force is at least equal to a force threshold.

In one embodiment, the method further comprises, before measuring the force exerted by the user on the arm, positioning the arm in a predetermined initial angular position.

In accordance with yet another broad aspect, there is provided a system for exercising a muscle, the system comprising: a machine for at least one of rehabilitation and exercise comprising a frame, a first arm movably secured to the frame, a first actuator operatively connected to the first arm for displacing the first arm with respect to the frame, a first force sensor for measuring a force exerted by a user on the first arm; a control unit operatively connected to the first actuator and the first force sensor, the control unit being adapted for controlling a displacement speed for the first arm via the first actuator as a function of the force and for increasing the displacement speed of the first arm via the first actuator when the force is superior to a target force; and an electrical potential sensor for location on the muscle for measuring an electrical potential generated by the muscle of the user while the user is exerting the force on the first arm, the electrical potential sensor being operatively connected to the control unit, the control unit being adapted for lowering the target force when the electrical potential is superior to a predetermined maximum electrical potential.

BRIEF DESCRIPTION OF THE DRAWINGS

Further features and advantages of the present invention will become apparent from the following detailed description, taken in combination with the appended drawings, in which.

DESCRIPTION

Figure 1:
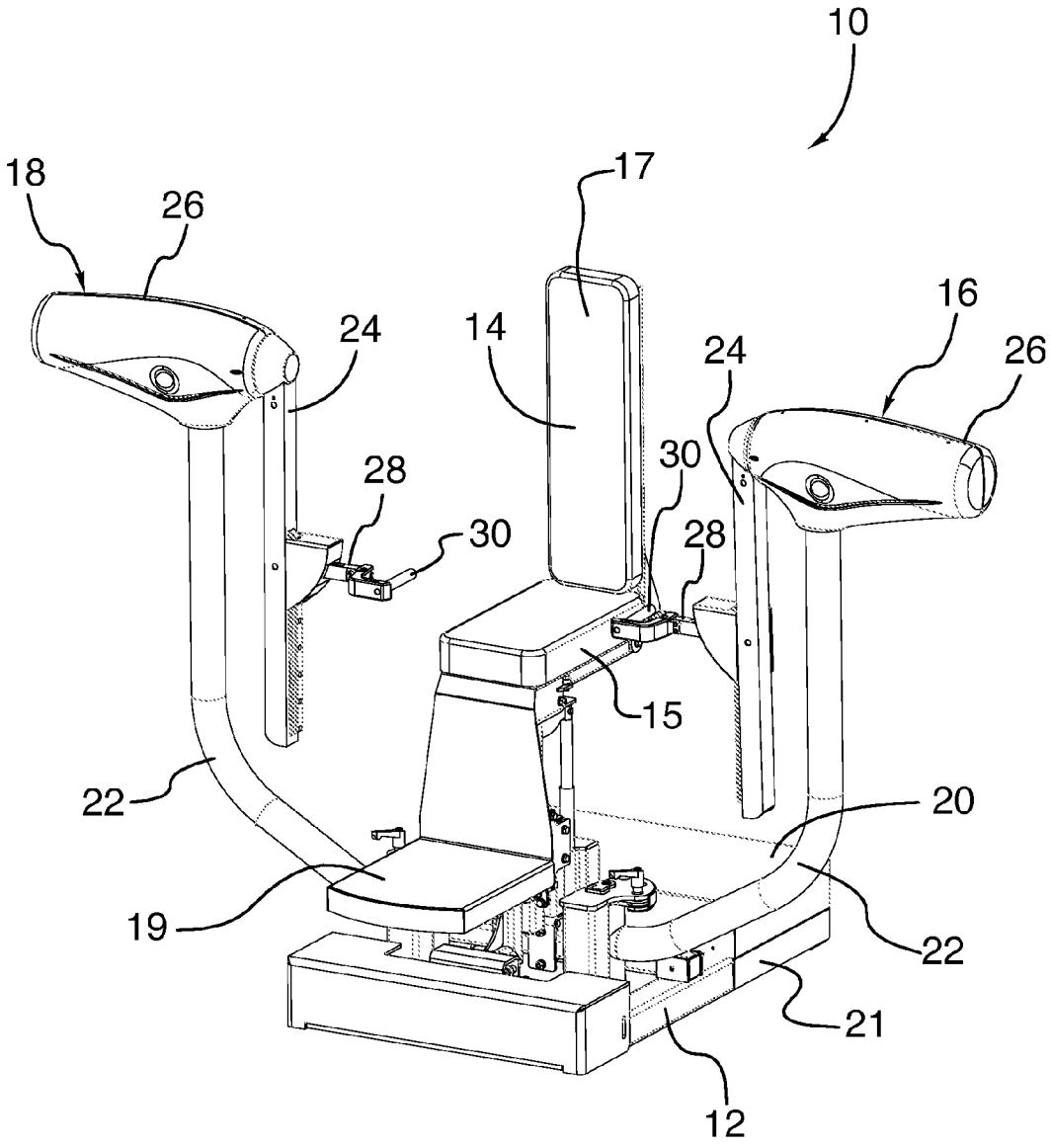
FIG. 1 is a perspective view of an exercise machine, in accordance with one embodiment.
Figure 2:
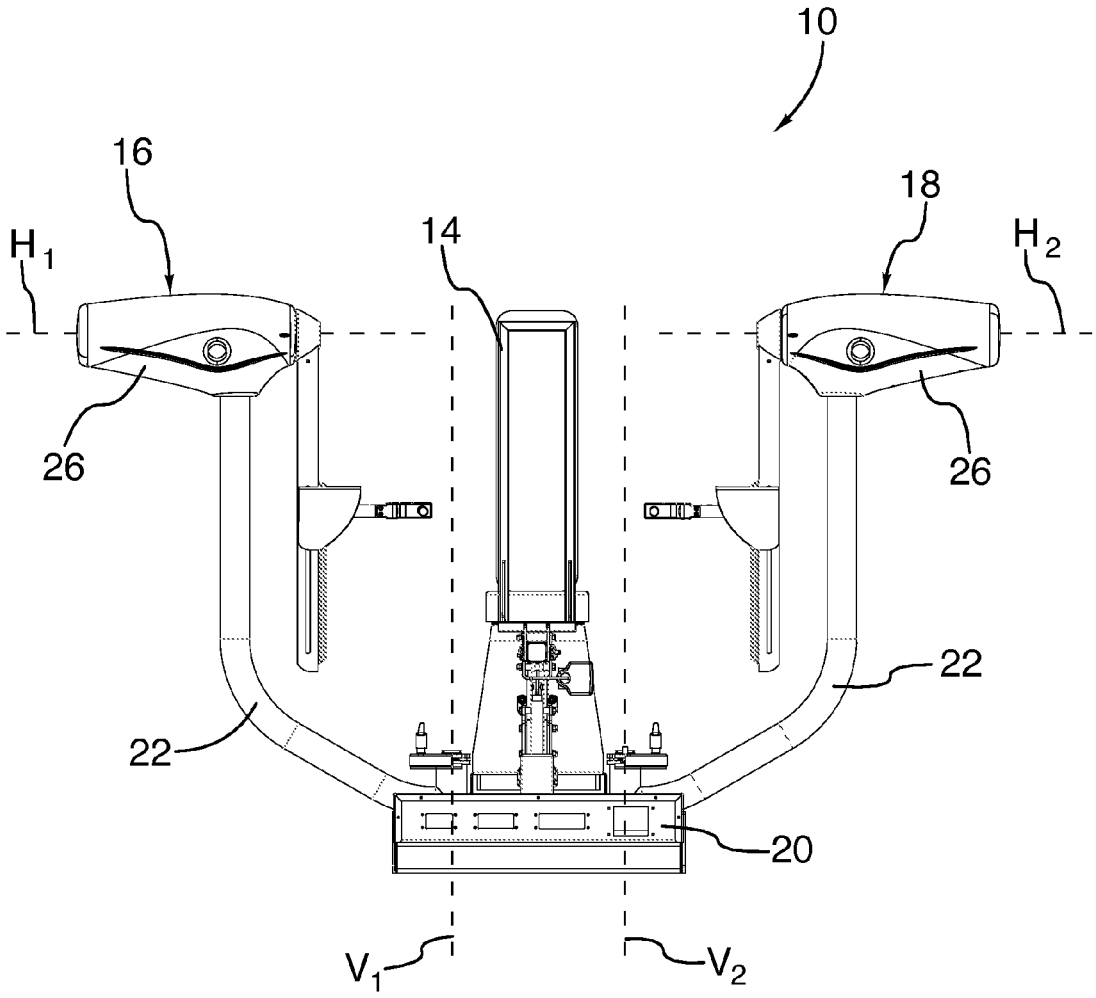
FIG. 2 is a rear elevation view of the exercise machine shown in FIG. 1.
Figure 3:
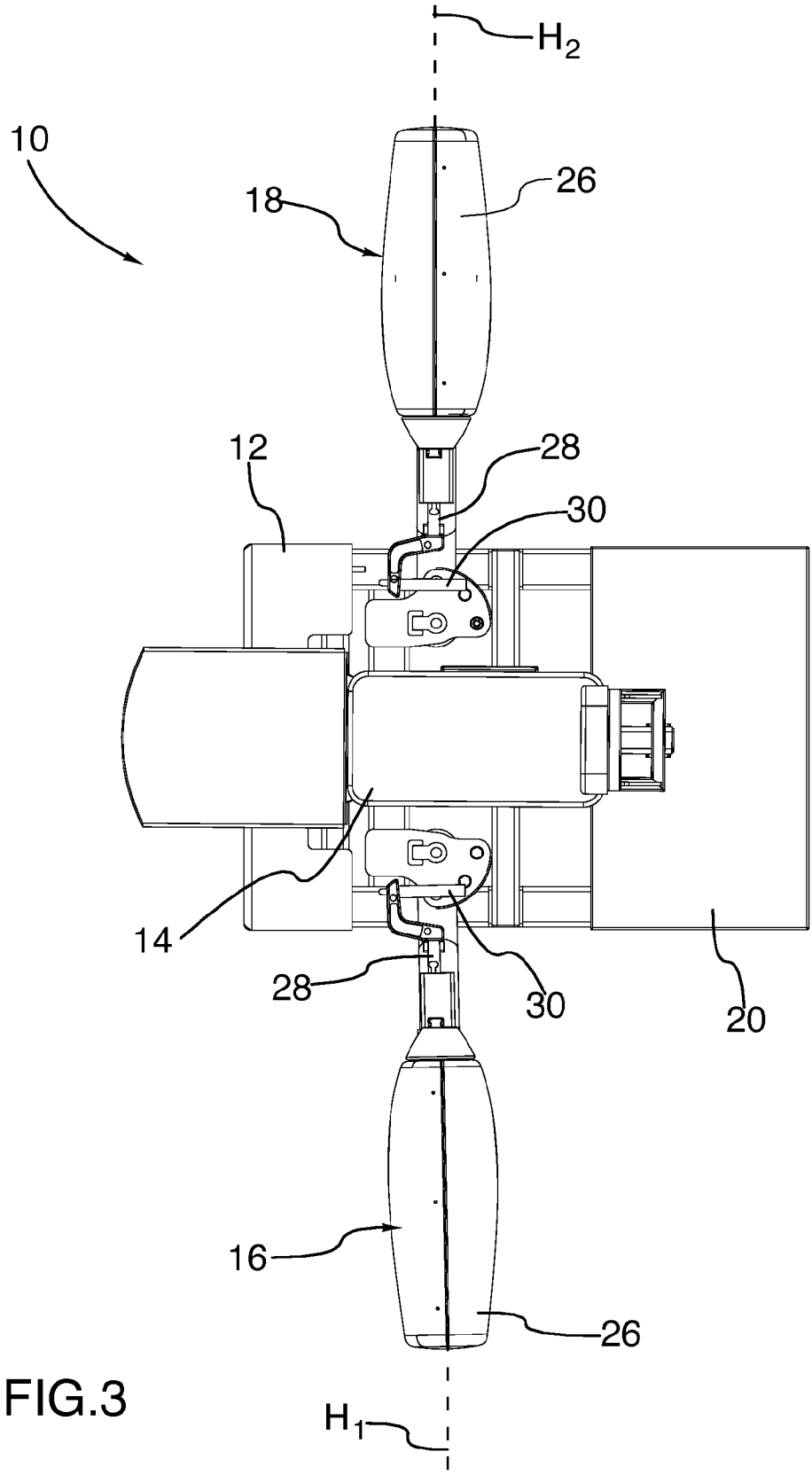
FIG. 3 is a top plan view of the exercise machine shown in FIG. 1.

FIGS. 1 to 3 illustrate one embodiment of an exercise machine 10 which can be used for rehabilitation of injured shoulders. The machine 10 comprises a frame 12, a seat 14, a left arm assembly 16, a right arm assembly 18, and a control unit 20.

The seat 14 is secured on top of the frame 12 and the arm assemblies 16, 18 are located next to the seat 14, on both sides thereof, to allow a user sitting on the seat 14 to reach the arm assemblies 16, 18. In the illustrated embodiment, the seat 14 comprises a sitting portion 15 which extends generally horizontally, a backrest portion 17 extending upwardly from the sitting portion 15 to allow the user to rest his back and properly position himself during an exercising session and a footrest portion 19 depending from the sitting portion 15 to allow the user to rest his feet during the exercising session.

In one embodiment, the sitting portion 15 has an area of 10 inches by 17 inches, or 25.4 centimeters per 43.18 centimeters, and a thickness of 3 inches or 7.62 centimeters.

In one embodiment, the backrest portion 17 has an area of 10 inches by 27.5 inches, or 25.4 centimeters per 69.85 centimeters, and a thickness of 3 inches or 7.62 centimeters.

In one embodiment, the footrest portion 19 has an area of 13 inches by 16.5 inches, or 33.02 centimeters per 41.91 centimeters.

The frame 12 comprises a base 21 which rests on the ground. In the illustrated embodiment, the base 21 is generally square and has an area of 28.75 inches by 42 inches, or 73.03 centimeters by 106.68 centimeters.

Each one of the left and right arm assemblies 16, 18 includes a support member 22 hingeably connected to the frame 12 to allow the left and right arm assemblies 16, 18 to be moved angularly relative to the seat 14 about left and right vertical axes $V_1$, $V_2$, respectively. Each one of the left and right arm assemblies 16, 18 further includes an arm 24 which is hingeably connected to the corresponding support member 22 to allow rotation of the arm 24 relative to the support member 22 about left and right horizontal axes $H_1$, $H_2$, respectively.

The position and the angular velocity of each arm 24 with respect to the frame 12 are controlled by a corresponding motor 26. Each arm 24 is provided with a force sensor 28 to which at least one handle 30 is secured to allow the force sensor 28 to measure the force exerted by the user on the handle 30.

In operation, a plurality of electrodes 32 (best shown in FIGS. 6A to 8C) are further placed on a surface area of the user's body, over a muscle which is activated when the user exerts a force on the handle 30. In one embodiment, the electrodes 32 are silver chloride electrodes and are mounted on a triode pad.

The electrodes 32 are operatively connected to an electromyograph (EMG) which measures an electrical potential generated by muscle cells when these cells are mechanically active during the motion of a muscle. In one embodiment, the electromyograph is a MyoTrac Infiniti™ encoder manufactured by Thought Technology Ltd. (Montreal, QC, Canada).

The control unit 20 is operatively connected to the force sensor 28 and to the motors 26 to allow the speed of the motors 26 to be adjusted according to the force exerted by the user on the handle 30. The speed of the motors 26 defines the angular velocity of the arm 24, and when the speed is adjusted a relatively high number of times over a relatively short period, the control unit 20 substantially controls the angular acceleration or deceleration of the arm 24, as one skilled in the art will appreciate.

The control unit 20 is further operatively connected to the EMG to receive muscle feedback from the electrodes 32 and to adjust the speed of the motors 26 according to this muscle feedback, as it will become apparent below.

It should be understood that any control unit adapted to control the position and rotational speed of the motor 26 in accordance with the measured force can be used. For example, the control unit 20 can be an automaton provided with a memory, a processor unit having an internal or external memory, or the like.

By controlling the acceleration or deceleration of the arm 24, the control unit 20 may therefore control the force applied on the handle 30 by the user, as it will become apparent below.

The right arm assembly 18 of the machine 10 will now be described in more details. Since the right arm assembly 18 and left arm assembly 16 are substantially similar, it will be appreciated that the following description of the right arm assembly 18 may also be applied to the left arm assembly 16.

Figure 4:
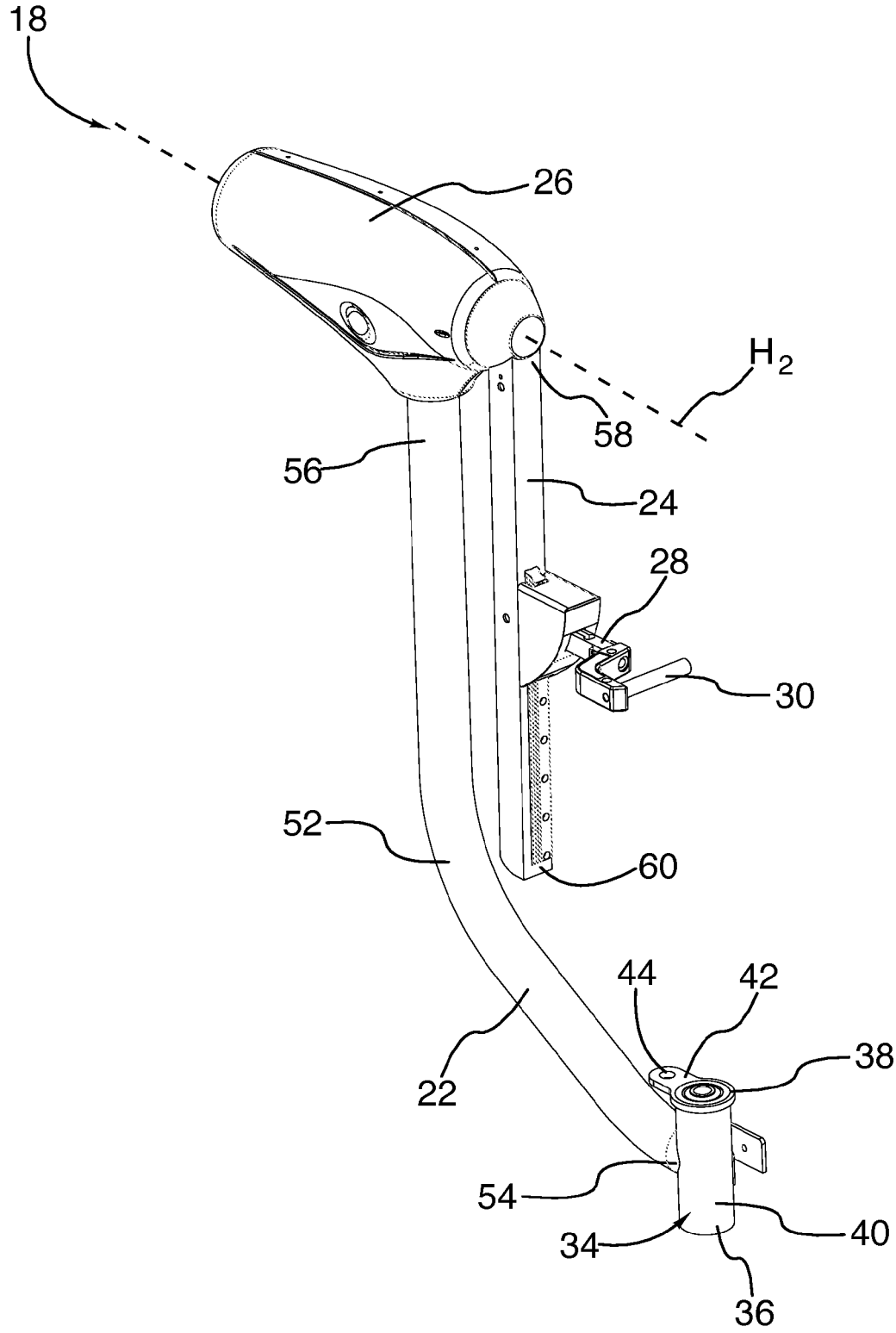
FIG. 4 is a perspective view of the right arm of the exercise machine shown in FIG. 1.
Figure 5:
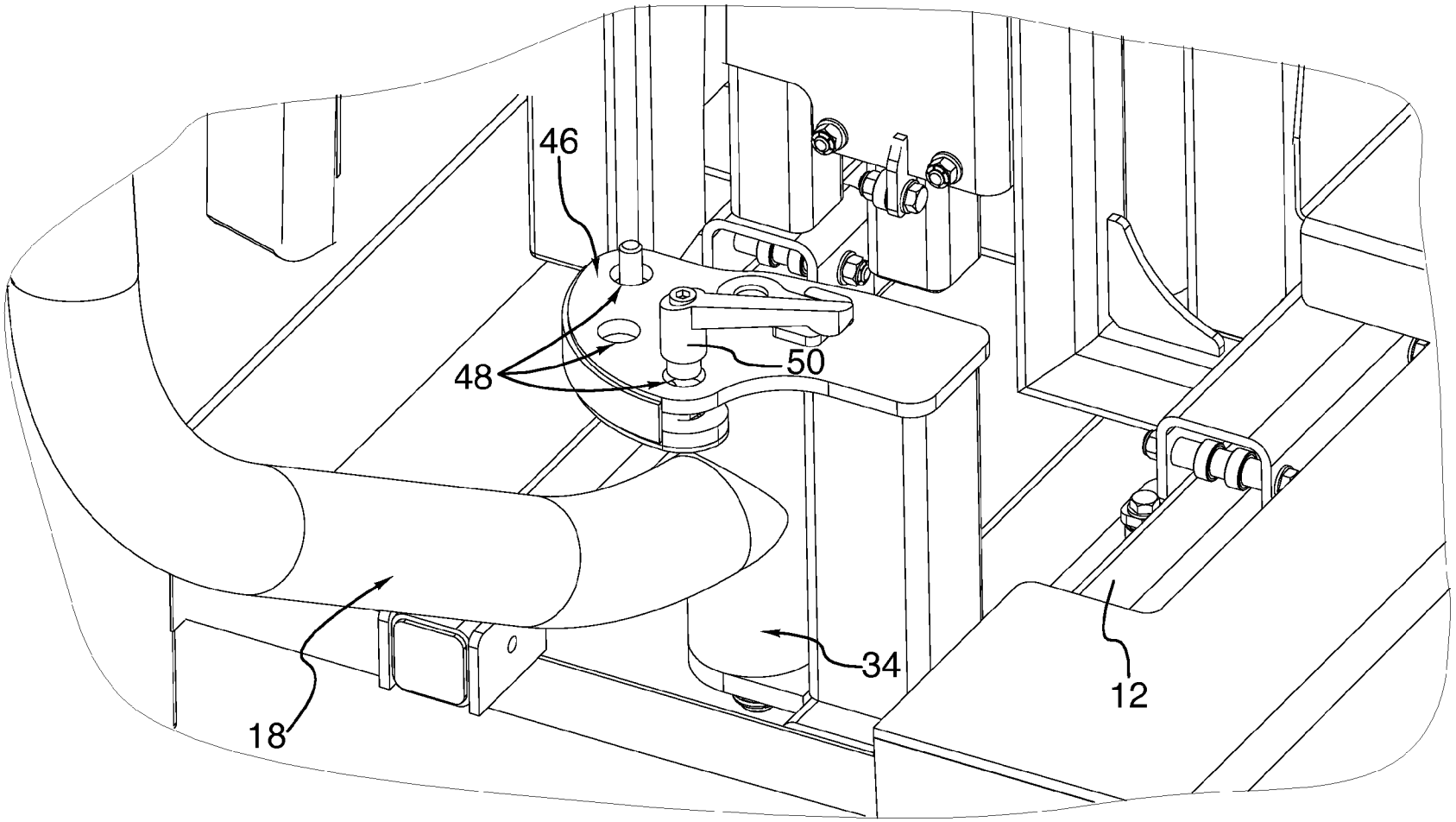
FIG. 5 is an enlarged view of the exercise machine shown in FIG. 1 showing the hingeable connection between the right arm and the frame.

Now referring to FIG. 4, the support member 22 of the right arm assembly 18 comprises a barrel 34 which extends generally vertically. The barrel 34 is adapted for engaging a corresponding pivot pin (not shown) of the frame 12 to allow the arm assembly to pivot relative to the frame 12. The barrel 34 has a bottom end 36, a top end 38 and a sidewall 40 extending between the top and bottom ends 36, 38. A positioning tab 42 extends generally radially from the sidewall 40 of the barrel 34, at the top end 36 of the barrel 34, and a hole 44 extends through the positioning tab 42. As shown in FIG. 5, the frame 12 comprises a corresponding positioning plate 46 which extends substantially horizontally over the top end 38 of the barrel 34 when the right arm assembly 18 is connected to the frame 12. A plurality of positioning holes 48 are defined in the positioning plate 42. Each of positioning holes 48 is adapted to register with the hole 44 of the positioning tab 42 when the right arm assembly 18 is angled about the right vertical axis $V_2$ at a predetermined angular position. For instance, in the illustrated embodiment, the positioning plate 46 comprises three (3) holes which respectively correspond to angular positions of 0 degrees, 45 degrees and 90 degrees of the right arm assembly 18 relative to the frame 12. A locking pin 50 is further provided to lock the right arm assembly 18 in place once the right arm assembly 18 has reached a desired angular position about the right vertical axis $V_2$, thereby preventing further angular movement of the right arm assembly 18 about the left vertical axis $V_2$.

Referring back to FIG. 4, the support member 22 of the right arm assembly 18 further comprises a curved member 52 extending from the barrel 34, away from the seat 14 and generally upwardly. The curved member 52 comprises a lower end 54 secured to the sidewall 40 of the barrel 34 and an upper end 56 secured to the motor 26. The axle of the motor 26 extends towards the seat 14 and defines the right horizontal axis $H_2$.

In one embodiment, the motor 26 comprises a servo-motor, such as an Allen-Bradley TLY-A2530P™ servo-motor manufactured by Rockwell Automation (Milwaukee, Wis., USA).

Still referring to FIG. 4, the arm 24 of the right arm assembly 18 has a first end 58 secured to the axle of the motor 26 and a second end 60 located away from the first end 58. When the right arm assembly 18 is in an idle or starting position, the arm 24 depends radially from the axle of the motor 26. In the illustrated embodiment, the handle 30 is slidably connected to the arm 24, near the second end 60, to enable the handle 30 to be selectively moved towards the user and away from the user. For instance, in one embodiment, the handle 30 is adapted to move over a distance of 12 inches, or 30.48 centimeters.

The motor 26 may further be coupled to a gear reduction mechanism which provides a relatively large torque output, as one skilled in the art will appreciate. This configuration advantageously allows the motor 26 to operate over a relatively wide range of force. In one embodiment, the gear reduction mechanism is a PL5090™ planetary gearbox manufactured by Boston Gear (Charlotte, N.C., USA).

In one embodiment, the position of the seat 14 is also adjustable with respect to the frame 12 so that the shoulders of the user may be adequately positioned with respect to the rotational axis of the arms 24. Alternatively, the seat 14 may further be motorized and connected to the control unit 20 so that the position of the seat 14 within the frame 12 is controlled by the control unit 20.

In one embodiment, the seat 14 is movable laterally—towards the left or right—over a distance of 6 inches, or 15.24 centimeters, is movable longitudinally—towards the front or rear—over a distance of 6 inches, or 15.24 centimeters, and is movable vertically over a distance of 6 inches, or 15.24 centimeters.

In order to exercise shoulders, a user sits on the seat 14. The user adjusts the height, the lateral position—towards the left or right—and the longitudinal position—towards the front or rear—of the seat 14 so that his shoulders are adequately positioned with respect to the arms 24. The user then positions his hands on the handles 30 of the arms 24 and exerts a pushing force on the handles 30 in order to upwardly move the arms 24. The force sensors 28 measure the pushing force applied by the user on the handles 24 and transmit the measured force to the control unit 18. The control unit 18 determines the rotational speed for the motors 20 and moves the arms 24 in accordance with the determined rotational speed.

In one embodiment, the arms 24 may rotate between two reference positions. The user upwardly pushes the arms 24 via the handles 30 starting from a first reference position. When they reach a second reference position, the arms 24 cannot be upwardly moved and the user has to downwardly pull the handles 30 in order to downwardly move the arms 24 back to the first reference position. These references position may be set using the control unit 20, as it will become apparent below. Alternatively, each one of the arms 24 may comprise a movement limiting mechanism which mechanically limits the movement of the arms 24 to a predetermined angular range. The predetermined angular range may further be selected by the user prior to the exercising session using a selector such as a rotatable selector knob operatively coupled to the gear reduction mechanism. This advantageously prevents the user from moving the arms 24 during the exercising session to an angular position which may cause injury to the user.

In one embodiment, each force sensor 22 is adapted to measure a pushing force exerted by the user on the corresponding handle 30 in order to lift the corresponding arm 24 with respect to the frame 12. In another embodiment, each force sensor 28 is adapted to measure a pulling force exerted by the user on the corresponding handle 30 in order to pull down the corresponding arm 24 with respect to the frame 12. In a further embodiment, each force sensor 28 is adapted to determine whether the force exerted by the user is a pushing force or a pulling force and to measure the corresponding pushing force or pulling force. In this case, each force sensor 28 is adapted to send an identification of the type of force applied by the user on the corresponding handle 30 to the control unit 20, and the control unit 20 is adapted to determine the velocity of the corresponding arm 24, i.e. the motion direction and the rotational speed of the corresponding arm 24.

Exercise Sequences

Examples of exercise sequences that may be performed using the exercise machine 10 shown in FIGS. 1 to 5 will now be described. Each exercise sequence may be part of an exercising session. In one embodiment, each exercise sequence is repeated a predetermined number of times. Different types of exercise sequences may also be alternated. It will be appreciated that the following exercise sequences correspond to the illustrated embodiment of the exercise machine 10, and that various other exercise sequences may be performed according to the features of the exercise machine 10 used.

Now referring to FIGS. 6A to 6C, one exercise sequence, known in the art as "extension/flexion", will now be described.

Figure 6C:
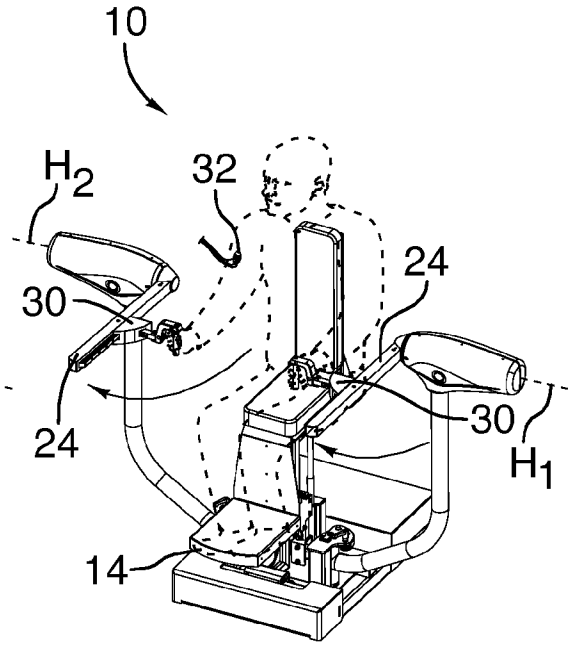
FIG. 6C is a perspective view of the exercise machine shown in FIG. 1, with a user performing an extension/flexion exercise sequence and with the arms in a frontwardly extended position.
Figure 6B:
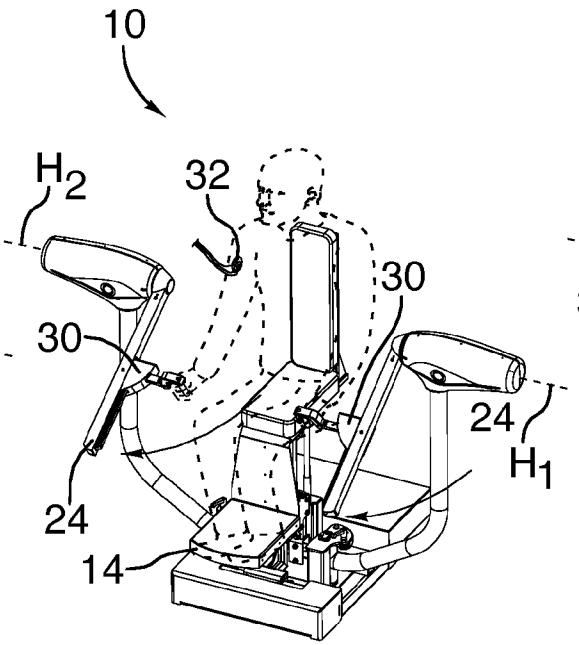
FIG. 6B is a perspective view of the exercise machine shown in FIG. 1, with a user performing an extension/flexion exercise sequence and with the arms in an intermediate position.
Figure 6A:
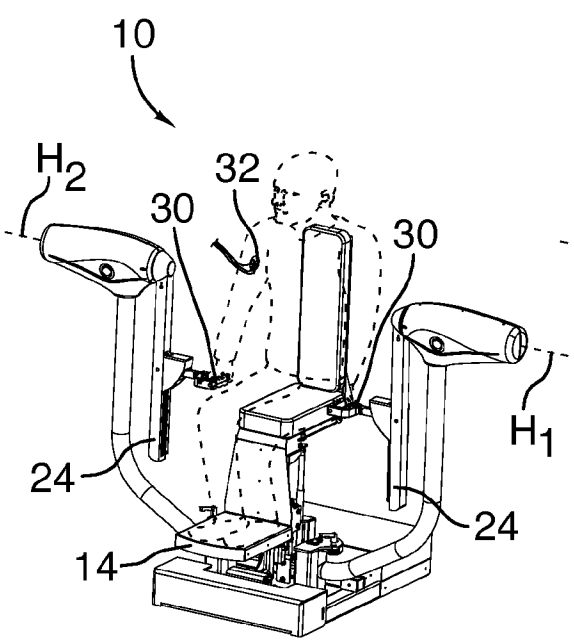
FIG. 6A is a perspective view of the exercise machine shown in FIG. 1, with a user performing an extension/flexion exercise sequence and with the arms in a base position.

In the extension exercise sequence, the arms 24 are positioned in a coronal exercise position shown in FIG. 6A. In this position, the horizontal axes $H_1$, $H_2$ are substantially aligned with each other and are substantially parallel to the coronal plane of the user's body, as one skilled in the art will appreciate.

The user sits on the seat 14 and his hands are positioned on the handles 30, as shown in FIG. 6A. The arms 24 may be set at an initial angular position which is determined by the user prior to the exercising session, as it will become apparent below. This initial angular position defines a base position shown in FIG. 6A. In the illustrated embodiment, when in the base position, the arms 24 extend generally vertically.

In one embodiment, the seat 14 is adjusted as described above to allow the user to position his hands on the handles 30 adequately to thereby advantageously reduce the risk of injuries during the exercising session.

The user then exerts a force on the handles 30 and pushes the arms 24 generally upwardly and frontwardly, thereby rotating the arms 24 generally upwardly and frontwardly about the horizontal axes $H_1$, $H_2$ towards an intermediate position shown in FIG. 6B.

The user continues pushing the arms 24 generally upwardly and frontwardly until a frontwardly extended position, shown in FIG. 6C, is reached. The frontwardly extended position may be determined prior to the exercising session according to various factors such as the physical condition of the user and/or the nature of an injury of the user. Alternatively, the frontwardly extended position may correspond to the second reference position described above.

From this position, another exercise sequence, known in the art as "flexion", may be performed. Flexion is the opposite of the extension. To perform this exercise sequence, the arms 24 are first positioned at the frontwardly extended position shown in FIG. 6C. This may be done prior to the exercising session, or the user may first perform an extension to rotate the arms 24 to the frontwardly extended position.

Similarly to the extension, the user sits on the seat 14 and his hands are positioned on the handles 30. The user then exerts a force on the handles 30 and pulls the arms 24 generally downwardly and rearwardly, thereby rotating the arms 24 generally downwardly and rearwardly about the horizontal axes $H_1$, $H_2$ towards the intermediate position shown in FIG. 6B.

The user continues pulling the arms 24 generally downwardly and rearwardly until the base position, shown in FIG. 6C, is reached.

Usually, flexions and extensions are alternated during an exercising session. The user first performs the extension, and, from the frontwardly extended position, then performs a flexion which brings the arms 24 back to the base position. From the base position, another extension may then be performed, followed by another flexion, until a predetermined number of repetitions is reached.

Now turning to FIGS. 7A to 7C, yet another exercising sequence, known in the art as "abduction/adduction", will now be described.

Figure 7C:
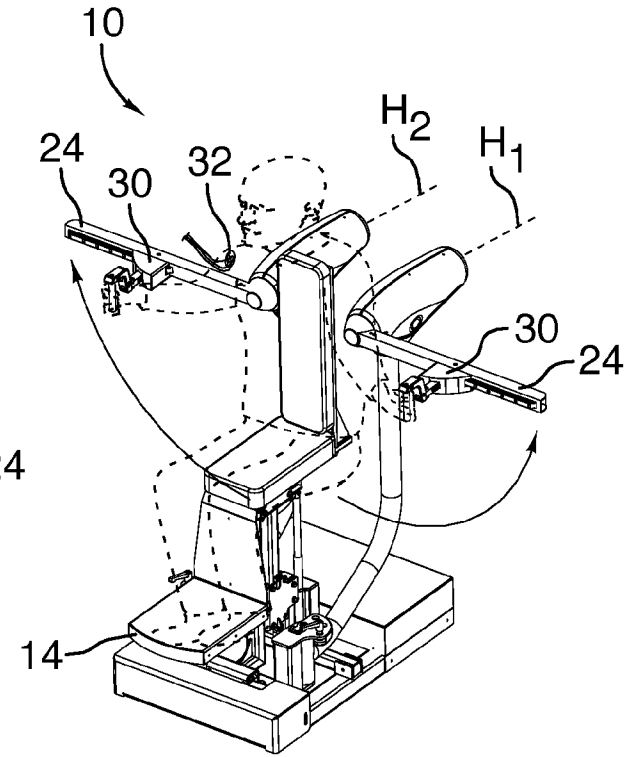
FIG. 7C is a perspective view of the exercise machine shown in FIG. 1, with a user performing an abduction/adduction exercise sequence and with the arms in a laterally extended position.
Figure 7B:
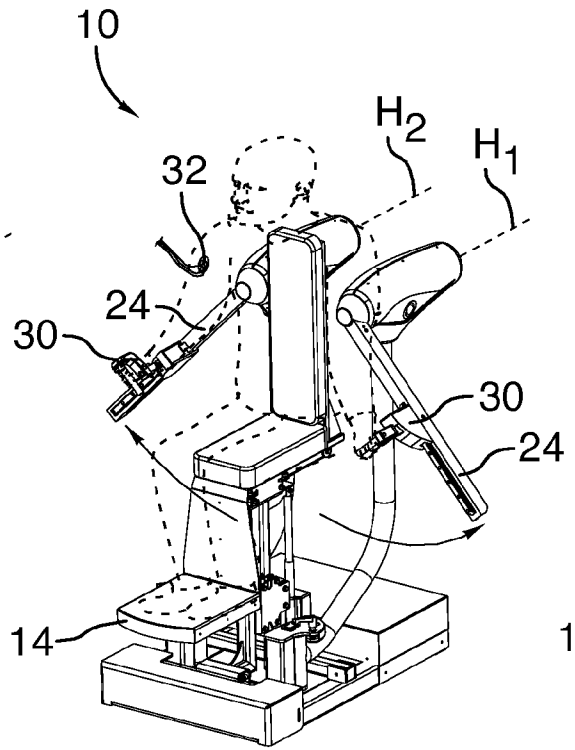
FIG. 7B is a perspective view of the exercise machine shown in FIG. 1, with a user performing an abduction/adduction exercise sequence and with the arms in an intermediate position.
Figure 7A:
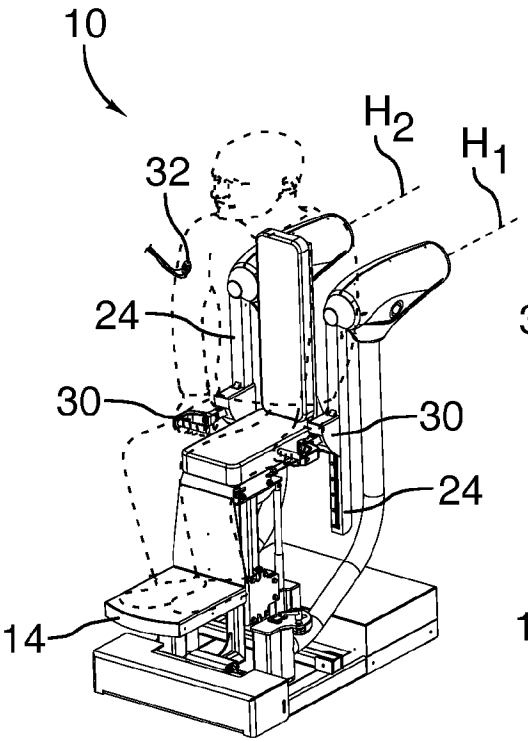
FIG. 7A is a perspective view of the exercise machine shown in FIG. 1, with a user performing an abduction/adduction exercise sequence and with the arms in a base position.

In the abduction exercise sequence, the arms 24 are positioned in a sagittal exercise position shown in FIG. 7A. In this position, the horizontal axes $H_1$, $H_2$ are substantially parallel to each other and are spaced from each other. The horizontal axes $H_1$, $H_2$ are further substantially parallel to the sagittal plane of the user's body, as one skilled in the art will appreciate.

A base position for this exercise sequence is shown in FIG. 7A. Similarly to the extension exercise sequence, the arms 24 may be set at an initial angular position which is determined by the user prior to the exercising session. In the illustrated embodiment, the arms 24 extend generally vertically.

The user sits on the seat 14 and his hands are positioned on the handles 30, as shown in FIG. 7A. The seat 14 may further be adjusted as explained above.

The user then exerts a force on the handles 30 and pushes the arms 24 generally upwardly and outwardly, away from his body, thereby rotating the arms 24 generally upwardly and laterally about the horizontal axes $H_1$, $H_2$ towards an intermediate position shown in FIG. 7B.

The user continues pushing the arms 24 generally upwardly and outwardly until the base position, shown in FIG. 7C, is reached.

Similarly to the frontwardly extended position, the laterally extended position may be determined prior to the exercising session according to various factors such as the physical condition of the user and/or the nature of an injury of the user. Alternatively, the laterally extended position may correspond to the second reference position described above.

From this position, another exercise sequence, known in the art as "adduction", may be performed. Adduction is the opposite of the abduction. To perform this exercise sequence, the arms 24 are first positioned at the laterally extended position shown in FIG. 7C. This may be done prior to the exercising session, or the user may first perform an abduction to rotate the arms 24 to the laterally extended position.

The user then exerts a force on the handles 30 and pulls the arms 24 generally downwardly and towards his body, thereby rotating the arms 24 generally downwardly and inwardly about the horizontal axes $H_1$, $H_2$ towards the intermediate position shown in FIG. 7B.

The user continues pulling the arms 24 generally downwardly and towards his body until the base position, shown in FIG. 7C, is reached.

Usually, abductions and adductions are alternated during an exercising session. The user first performs the abduction, and, from the laterally extended position, then performs an adduction which brings the arms 24 back to the base position. From the base position, another abduction may then be performed, followed by another adduction, until a predetermined number of repetitions is reached.

It will be appreciated that the above-described exercise sequences may be combined during a single exercising session, according to a training program conceived by the user, by a technician or by a health professional. Alternatively, a plurality of different training programs may be programmed in the control unit 20 to allow the user to select a desired training program prior to an exercising session.

Figure 8C:
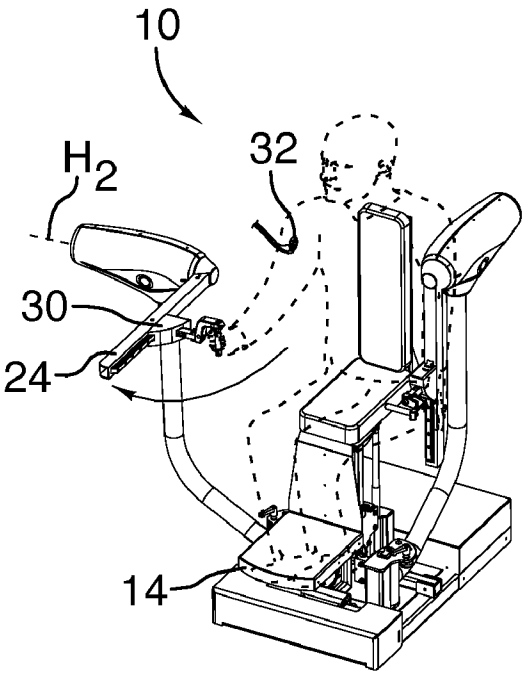
FIG. 8C is a perspective view of the exercise machine shown in FIG. 1, with a user performing an extension/flexion exercise sequence using a single arm and with the arm of the right arm assembly in a frontwardly extended position.
Figure 8B:
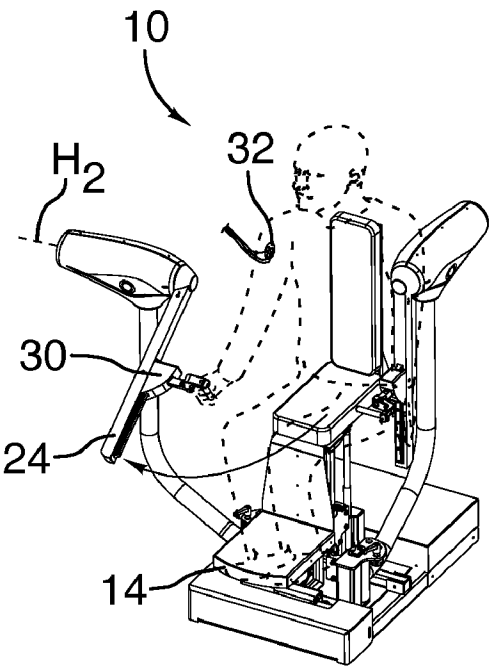
FIG. 8B is a perspective view of the exercise machine shown in FIG. 1, with a user performing an extension/flexion exercise sequence using a single arm and with the arm of the right arm assembly in an intermediate position.
Figure 8A:
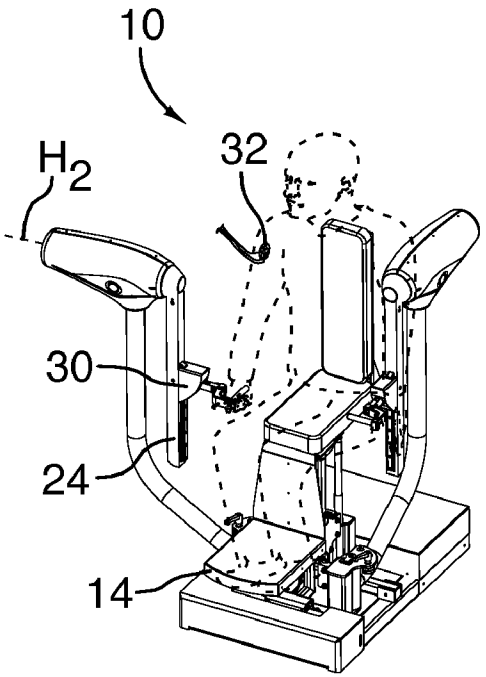
FIG. 8A is a perspective view of the exercise machine shown in FIG. 1, with a user performing an extension/flexion exercise sequence using a single arm and with the arm of the right arm assembly in a base position.

In one embodiment, the above-described exercise sequences may further be performed using a single arm. For instance, FIGS. 8A to 8C show the user performing an extension using a single arm, in this case the right arm. During this exercise sequence, the left arm is unused.

In the illustrated embodiment, the left and right arm assemblies 16, 18 are positioned such that the horizontal axes $H_1$ and $H_2$ are substantially perpendicular to each other. Alternatively, the left and right arm assemblies 16, 18 may be positioned such that the horizontal axes $H_1$ and $H_2$ are substantially aligned with each other, similarly to the base position shown in FIG. 6A.

From a base position shown in FIG. 8A, the user exerts a force on the handle 30 of the arm 24 of the right arm assembly 18 and pushes the arm 24 substantially upwardly and frontwardly towards an intermediate position, shown in FIG. 8B. The user continues pushing the arm 24 of the right arm assembly 18 upwardly and frontwardly until a frontwardly extended position, shown in FIG. 8C, is reached.

It will be appreciated that each of the arms of the user may be exercised individually according to any of the exercises sequences described above, depending on the conceived training program. For instance, a user having an injury located on the right side of his body may exercise only his right arm. Alternatively, the conceived training program may comprise exercising sessions in which different exercises for exercising the left arm, the right arm or both arms are performed.

In one embodiment, the handles 30 are removable and mountable on the arms 24 in one of a first and a second position. In the first position, the handles 30 are substantially parallel to the sagittal plane of the user's body when the arms 24 are in the coronal exercise position, and substantially parallel to the coronal plane of the user's body when the arms 24 are in the sagittal exercise position. In the second position, the handles 30 are substantially perpendicular to the sagittal plane of the user's body when the arms 24 are in the coronal exercise position, and substantially perpendicular to the coronal plane of the user's body when the arms 24 are in the sagittal exercise position.

In one embodiment, in order to allow the user to exercise a single one of his arms/shoulders, the machine 10 may be set in one of eight (8) configurations.

According to a first configuration, the left arm 16 is set in the coronal exercise position and the handle 30 of the left arm 16 is set in the first position to allow the user to perform extension and/or flexion movements using his left arm.

According to a second configuration, the left arm 16 is set in the coronal exercise position and the handle 30 of the left arm 16 is set in the second position to allow the user to perform extension and/or flexion movements using his left arm.

According to a third configuration, the left arm 16 is set in the sagittal exercise position and the handle 30 of the left arm 16 is set in the first position to allow the user to perform abduction and/or adduction movements using his left arm.

According to a fourth configuration, the left arm 16 is set in the sagittal exercise position and the handle 30 of the left arm 16 is set in the second position to allow the user to perform abduction and/or adduction movements using his left arm.

According to a fifth configuration, the right arm 18 is set in the coronal exercise position and the handle 30 of the right arm 18 is set in the first position to allow the user to perform extension and/or flexion movements using his right arm.

According to a sixth configuration, the right arm 18 is set in the coronal exercise position and the handle 30 of the right arm 18 is set in the second position to allow the user to perform extension and/or flexion movements using his left arm.

According to a seventh configuration, the right arm 18 is set in the sagittal exercise position and the handle 30 of the right arm 18 is set in the first position to allow the user to perform abduction and/or adduction movements using his right arm.

According to an eight configuration, the right arm 18 is set in the sagittal exercise position and the handle 30 of the right arm 18 is set in the second position to allow the user to perform abduction and/or adduction movements using his right arm.

Operation

Figure 9:
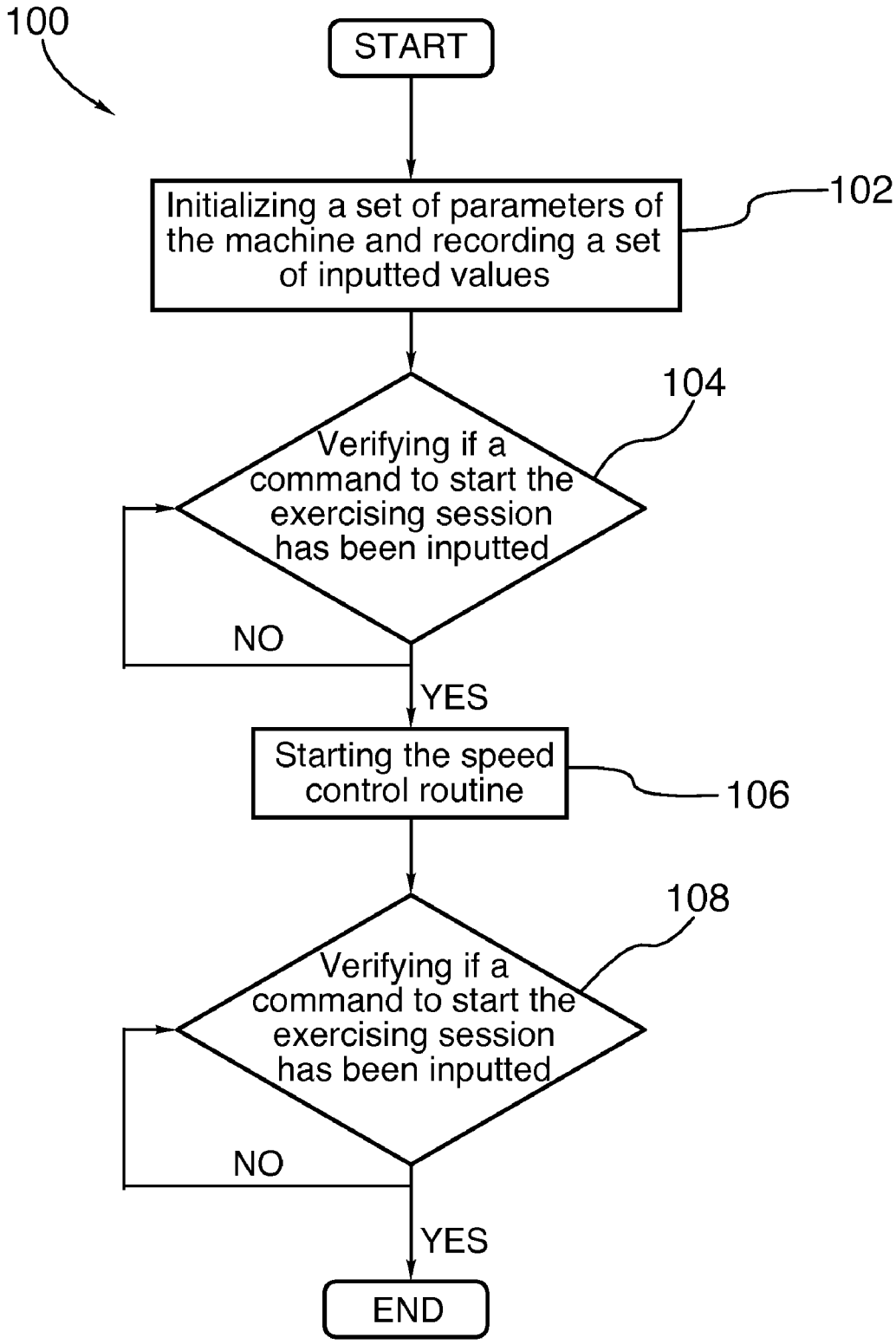
FIG. 9 is a flow chart of a method for operating the exercise machine of FIG. 1, in accordance with one embodiment.

FIG. 9 illustrates one embodiment of a method 100 for operating the exercise machine 10 of FIGS. 1 to 5.

In one embodiment, prior to an exercising session, the user first performs a warm-up sequence using a free weight. The free weight is held in the hand on the side of the user's body where the muscle to be exercised is located, and extension and abduction sequences are performed by the user for a predetermined period. In the case in which muscles in both sides of the body are to be exercised during the exercising session, a free weight is held in each hands of the user. In one embodiment, the extension and abduction sequences are performed by the user for about 1 minute and 30 seconds.

The electrodes 32 are positioned on surfaces of the arms and/or shoulders of the user, over the muscles to be exercised during the exercising session. In one embodiment, the skin on the surfaces of the arms and/or shoulders of the user on which the electrodes 32 are to be placed is washed with alcohol before the electrodes are positioned on the surfaces of the arms and/or shoulders. The electrodes 32 may be placed according to the orientation of the muscle fibers of the muscles to be exercised. The location of the surfaces of the arms and/or shoulders on which to place the electrodes may further be selected according to the procedure of Delagi, which is widely known in the art.

During the exercising session, the user upwardly pushes the arms 24 of the exercise machine 10, and/or downwardly pulls the arms 24, as described above.

According to step 102, a set of parameters of the machine are initialized and a set of values are inputted in the control unit 20, as it will become apparent below.

According to step 104, the control unit 20 verifies if a command to start the exercising session has been inputted. If the command to start the exercising session has not been inputted, then step 104 restarts and the control unit 20 once again verifies if a command to start the exercising session has been inputted. This command may be inputted by a technician through a computer operatively connected to the control unit 20, for instance. Alternatively, the command to start the exercising session may be inputted directly on the control unit 20, through a push button or a switch for instance. In yet another embodiment, the command to start the exercising session may be programmed directly in the control unit 20. For instance, step 104 may be performed after a predetermined amount of time has passed after the execution of step 102.

According to step 106, once a command to start the exercising session has been inputted, the control unit starts the speed control routine, which will be detailed below.

According to step 108, the control unit 20 then verifies if a command to stop the exercising session has been inputted. If not, then step 108 restarts and the control unit 20 once again verifies if a command to stop the exercising session has been inputted, while the speed control routine of step 106 is still running.

When a command to stop the exercising session is inputted, the control unit 20 stops the speed control routine of step 106.

In one embodiment, a plurality of controlled stop switches are further provided, each one allowing the user and/or the technician operating the exercise machine 10 to stop movement of the arms 24, which are maintained at the position in which they were located just prior to the activation of the control stop switch. Specifically, a first controlled stop switch may be provided on an interface of a control computer operatively connected to the control unit 20 and a second and a third controlled stop switches may be provided on the exercise machine 10, near the seat 14, to allow the user to reach them with relative ease during the exercising session.

In one embodiment, a plurality of deactivating switches are provided, each one allowing the user and/or the technician operating the exercise machine 10 to stop movement of the arms 24 and return the arms 24 to their base position under the effect of gravity. Specifically, a first deactivating switch may be provided directly on the control unit 20 and a second deactivating switch may be provided remotely from the exercise machine 10, such that it may be positioned near and accessible by the technician remotely operating the exercise machine 10.

Figure 10:
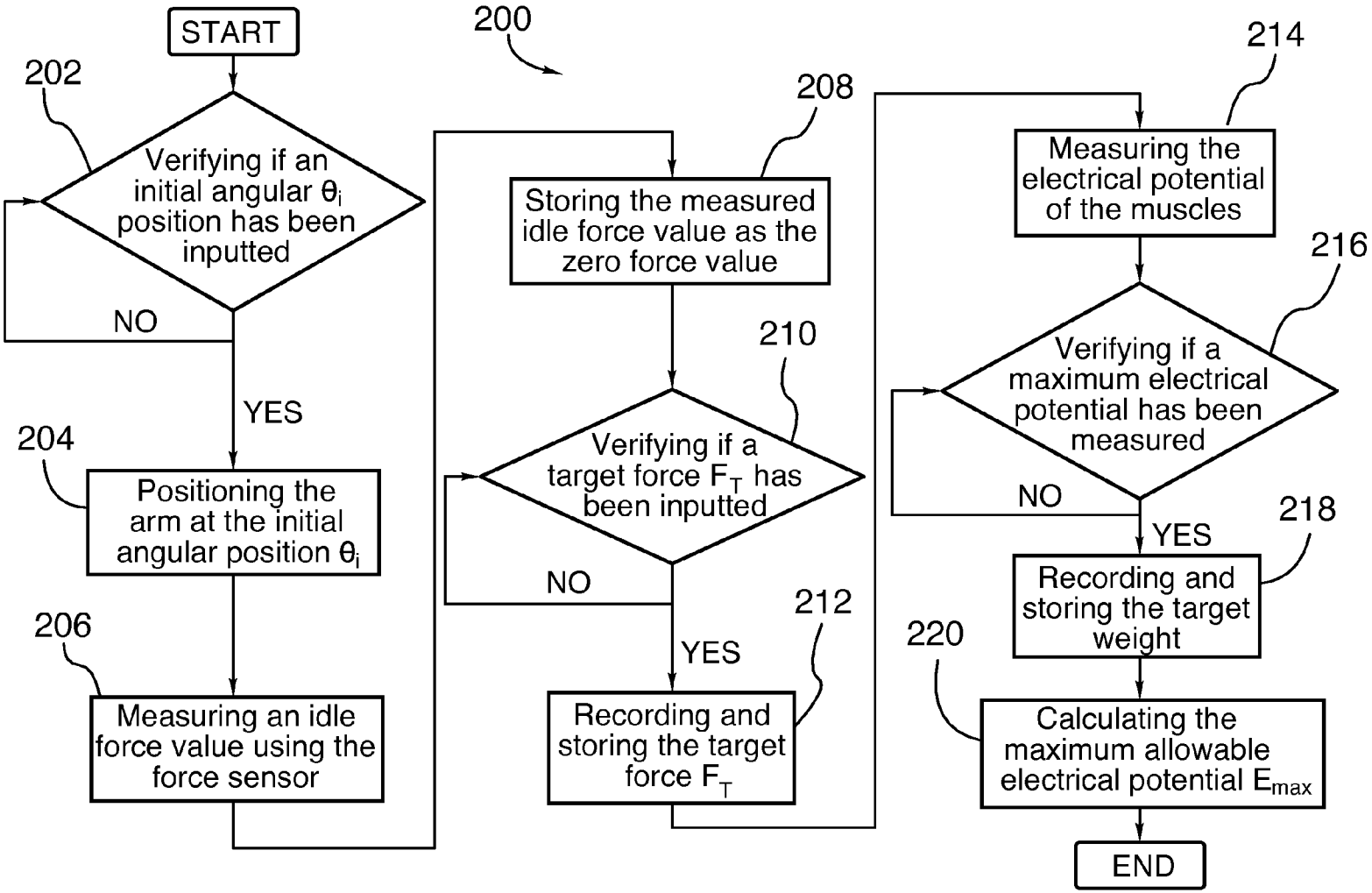
FIG. 10 is a flow chart of a method for initializing a set of parameters of the machine and recording a set of inputted values, in accordance with one embodiment.

Now referring to FIG. 10, step 102 of the method 100 may further be divided in a plurality of sub-steps forming method 200.

According to sub-step 202, the control unit 20 verifies if an initial angular position $\theta_i$ of the arms 24 has been inputted. If the initial angular position $\theta_i$ has not yet been inputted, then step 202 restarts and the control unit 20 once again verifies if the initial angular position $\theta_i$ has been inputted. The initial angular position $\theta_i$ may be inputted by a technician through a computer operatively connected to the control unit 20, for instance. It will be appreciated that the initial angular position $\theta_i$ may be selected according to various factors such as the physical condition of the user and to the type of exercise to be performed.

In one embodiment, the initial angular position $\theta_i$ is the same for the arm 24 of the right arm assembly 18 and of the left arm assembly 16. In an alternative embodiment, the first initial angular position $\theta_{i1}$ is inputted to indicate the initial angular position of the arm 24 of the left arm assembly 16 and a second initial angular position $\theta_{i2}$ is inputted to indicate the initial angular position of the arm 24 of the right arm assembly 18.

Figure 11:
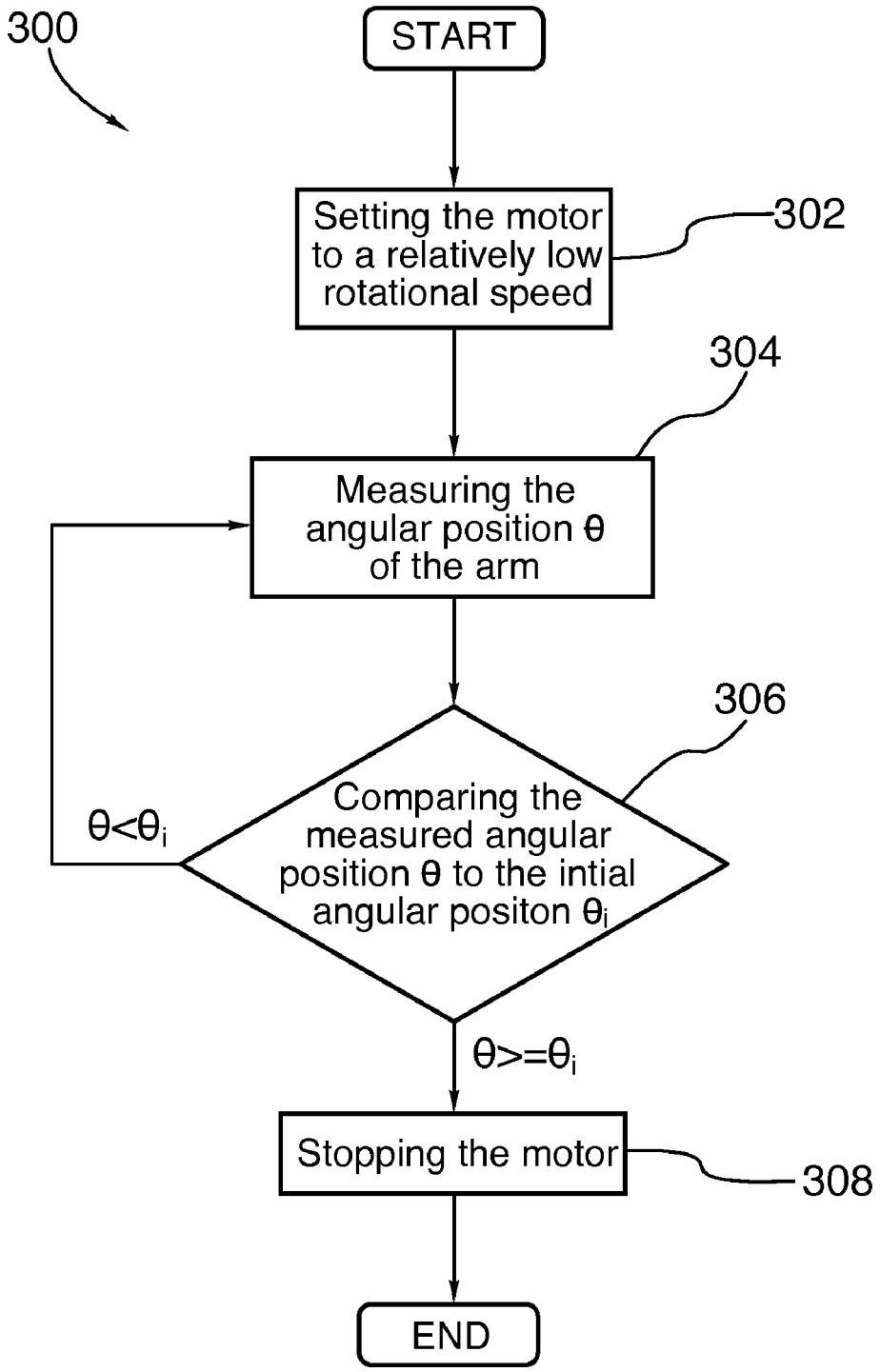
FIG. 11 is a flow chart of a method for positioning the arm of the exercise machine shown in FIG. 1 at an initial angular position, in accordance with one embodiment.

According to sub-step 204, the arms 24 are then positioned at the initial angular position $\theta_i$ by the control unit 20 via the motors 26. FIG. 11 shows a method 300 for positioning the arms 24 at the initial angular position $\theta_i$. The motors 26 are first set to a relatively low speed, in accordance with sub-step 302. According to sub-step 304, an angular position $\theta$ of the arms 24 is then measured using the control unit 20. In sub-step 306, the measured angular position $\theta$ is compared to the inputted initial angular position $\theta_i$. If the measured angular position $\theta$ is lower than the initial angular position $\theta_i$, the angular position $\theta$ is re-measured and once again compared to the initial angular position $\theta_i$. If, instead, the measured angular position $\theta$ is equal to or greater than the initial angular position $\theta_i$, meaning that the desired initial angular position $\theta_i$ has been reached or slightly exceeded, the motor will be stopped.

Referring back to FIG. 10, an idle force value, which represents the force measured by the force sensor 28 when no force is exerted on the arms 24, is then measured, in accordance with sub-step 206. Then, according to sub-step 208, the measured idle force value is stored as the zero force value of the force sensor 28. In other words, the zero of the force sensor 28 is reset. It will be appreciated that sub-steps 206 and 208 advantageously prevent incorrect measurements of force using the force sensor, which may undesirably lead to injuries to the user or worsen an existing injury of the user.

According to sub-step 210, the control unit 20 then verifies if a target force $F_T$ of the arms 24 has been inputted. The target force $F_T$ represents a predetermined force that a user may want not to exceed in order to avoid an injury or worsening an injury. In other words, the target force $F_T$ simulates a weight or charge that the user should pull or push during the exercising session. If the target force $F_T$ has not yet been inputted, then sub-step 210 restarts and the control unit 20 once again verifies if the target force $F_T$ has been inputted. The target force $F_T$ may be inputted by a technician through a computer operatively connected to the control unit 20, for instance. It will be appreciated that the target force $F_T$ may be selected according to various factors such as the physical condition of the user and to the type of exercise to be performed.

In one embodiment, instead of a target force $F_T$, a target mass $M_T$ is inputted. It may be advantageous for a user to input a mass instead of a force to more easily simulate real-life training or work conditions. For instance, an injured worker being rehabilitated using the exercise machine 10 may, during exercising sessions, set the machine to a target mass $M_T$ which represents the average mass of objects that he often carries at work. In this case, the exercising session would simulate the lifting and/or handling of those objects.

It will be appreciated that the conversion from target force $F_T$ to target mass $M_T$ may be performed using the well-known formula:

$$F_T = M_T g \quad \text{(Equation 1)}$$

where g represents the standard gravity, which is about 9.81 $m/s^2$ or 32.2 $ft/s^2$.

According to sub-step 212, once the target force $F_T$ or target mass $M_T$ has been inputted, it is stored for use in the control of the rotational speed of the motors 26, as it will become apparent below.

Sub-step 214 consists in measuring the electrical potential of the muscles to be exercised during the exercising session. For this sub-step to be performed, the user presses or pulls with maximum force on the handles 30 while the arms 24 are prevented from moving by the control unit 20. A maximum electrical potential generated by the targeted muscles is then recorded by the EMG through the electrodes 32. If the user only uses a single arm 24 to exercise a single shoulder, then the first step 102 consists in measuring the maximum electrical potential of the muscles of the single arm and/or shoulder of the user to be exercised. According to sub-step 216, the control unit 20 verifies if a value of electrical potential has been measured. In other words, the control unit 20 verifies if the user has made any effort with the muscles to be exercised. If no value of electrical potential have yet been measured, then step 216 restarts and the control unit 20 once again verifies if a value of electrical potential has been measured.

To obtain a more representative value of the maximum electrical potential, the user may push or pull the handles 30 more than one time. In this case, the control unit 20 records multiple electrical potentials, one for each push or pull, and gives the maximum electrical potential the highest recorded value. In one embodiment, measurement of the maximum electrical potential is performed over a predetermined period, for instance one minute, during which the user may push and/or pull the handles 30 any number of times. In an alternative embodiment, measurement of the maximum electrical potential is performed until a predetermined number of values are recorded, for instance five (5) values. In both those embodiments, the control unit 20 assigns the highest recorded value to the maximum electrical potential.

According to sub-step 218, the value of the measured maximum electrical potential is then recorded and stored in the control unit 20.

According to sub-step 220, the control unit 20 determines a maximum allowable electrical potential $E_{max}$ based on the measured maximum electrical potential. The maximum allowable electrical potential $E_{max}$ corresponds to a maximum level of muscular effort which should not be exceeded during the exercise session, for instance to prevent worsening an injury. In one embodiment for instance, the maximum allowable electrical potential $E_{max}$ is set at 30% of the measured maximum electrical potential.

In an alternative embodiment, the electrodes 32 and/or the EMG are instead operatively connected to a computer which analyzes the measured electrical potential. In this embodiment, the computer may further be programmed to store the measured electrical potential into a database. The computer may alternatively be programmed to filter the signal received from the EMG and/or from the electrodes 32 using filtering methods known to the skilled addressee. The computer may also be operatively connected to the control unit 20 to enable it to send filtered values of measured electrical potential to the control unit 20 so that the control unit 20 may control the motors 26 accordingly.

Alternatively, the electrodes 32 and/or the EMG may instead be operatively connected to a display unit to enable a technician to visualize the recorded maximum electrical potential. The maximum allowable electrical potential $E_{max}$ may then be calculated by the technician and inputted manually into the control unit 20 by the technician based on the visualized values.

Once the maximum allowable electrical potential $E_{max}$ has been calculated and the command to start the exercising session has been inputted, the speed control routine of step 106 starts.

Figure 12:
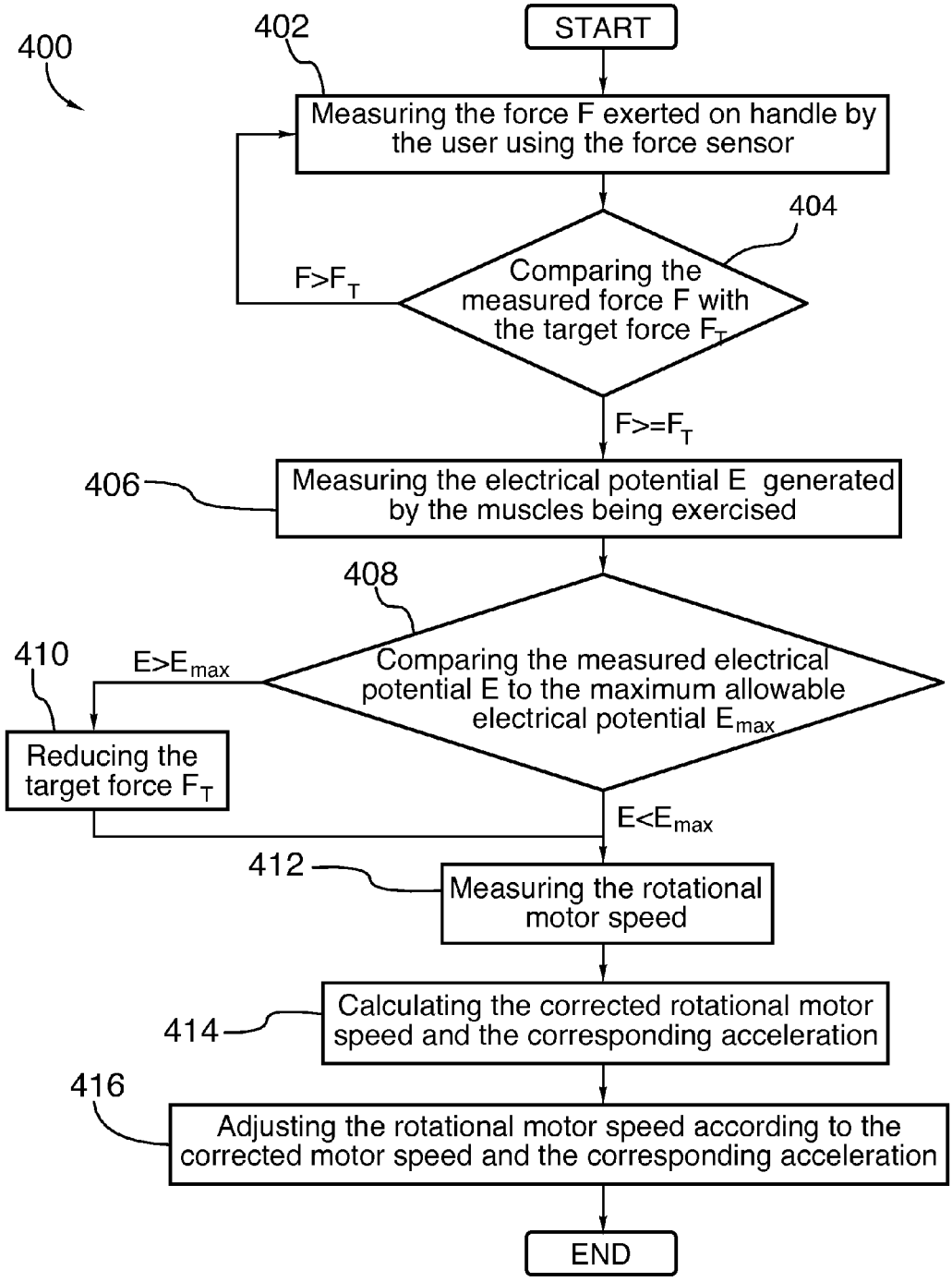
FIG. 12 is a flow chart of a method for controlling the rotational speed of an arm of the exercise machine shown in FIG. 1, in accordance with one embodiment.

FIG. 12 shows a method 400 for controlling the speed of the motors 26, and thereby of the arms 24. The arms 24 are not displaced directly by the force exerted by the user on the arms 24 via the handles 30. Only the motors 26 are capable of displacing the arms 24 with respect to the frame 12. The rotational speed for each of the arms 24 is determined as a function of the corresponding measured force F compared to the target force $F_T$. The force sensors 28 measure the force F exerted by the user on the handles 30 and transmit the value of the measured forces to the control unit 20 which determines if the arms 24 should be displaced and, if so, the motion direction and the rotational speed for each of the arms 24. If it determines that the arms 24 should be displaced, the control unit 20 determines the new rotational speed for the arms 24 and sets the speed of the motors 26 so that the rotational speed of the arms 24 is equal to their corresponding new rotational speed.

In one embodiment, the measurement of the force exerted on the handles 30 and the determination of the corresponding speed for the arms 24 is performed in substantially real-time so that substantially no time delay exists between the force F exerted by the user and the adjustment of the displacement speed of the arms 24. The substantially real-time functioning of the machine 10 allows for the reduction of the risk that the user exerts a force which could cause an injury or worsen an injury.

In one embodiment, the force F exerted by the user must exceed an initial threshold $T_{in}$ in order to start the rotation of the arms 24. The initial threshold $T_{in}$ corresponds to a minimum weight or charge that the user must push or pull in order to start the exercising session. The force sensors 28 periodically or substantially constantly measure the force exerted by the user on the respective handle 30 and periodically or substantially constantly send the values of the measured forces to the control unit 20 which controls the motors 26.

For instance, in step 402, the force F exerted on the handles 30 by the user is first measured using the force sensors 28. The measured force F is then compared to the target force $F_T$ in step 404. In this case, an initial threshold $T_{in}$ is the target force $F_T$, which must be equaled or exceed by the force F exerted on the handles 30 by the user in order to proceed to the next step of the method. If the force F exerted on the handles 30 by the user is lesser than the target force $F_T$, the routine goes back to step 402, and the force F is measured once again.

According to step 406, an electrical potential E generated by the muscles being exercised is measured. In step 408, this electrical potential E is then compared to the maximum allowable electrical potential $E_{max}$. If the measured electrical potential E is inferior or equal to the maximum allowable electrical potential $E_{max}$, then the method 400 proceeds to step 412. If the measured electrical potential E is superior to the maximum allowable electrical potential $E_{max}$, then the control unit 20 reduces the target force $F_T$. The target force $F_T$ is then set to the value of the measured force F when the electrical potential substantially reached the maximal electrical potential or just before the electrical potential reached the maximal electrical potential. This advantageously ensures that the user will not exceed a maximal effort which could worsen an injury. Alternatively, the target force $F_T$ may be decreased by an amount $\Delta T$ which can be predetermined or determined using the measured electrical potential E and the maximum allowable electrical potential $E_{max}$. This results in a decreased simulated charge. The new target force ($F_T - \Delta T$)

is then used for determining the rotational speed of the arms 24 in accordance with the method 400.

In one embodiment, the target force $F_T$ is reduced by an amount which is proportional to the difference between the measured electrical potential E and the maximum allowable electrical potential $E_{max}$. For instance, the reduction of the target force $F_T$ may be calculated using the following equations:

$$\frac{E - E_{max}}{E_{max}} \cdot 100\% = \Delta E \quad \text{(Equation 2)}$$

$$F_T^* = F_T - (F_T \cdot \Delta E) \quad \text{(Equation 3)}$$

where $F_T$* is the reduced target force $F_T$.

In step 412, the rotational speed V of the motors 26 is measured. Using this rotational motor speed V and the measured force F exerted on the handles 30 by the user, the control unit 20 then calculates the corrected motor speed and the corresponding acceleration in accordance with step 414, as it will become apparent below.

In step 416, the control unit 20 adjusts the rotational speed of the motors 26 according to the corrected motor speed and the corresponding acceleration and the speed control routine restarts until a command to stop the exercising session is inputted.

Figure 13:
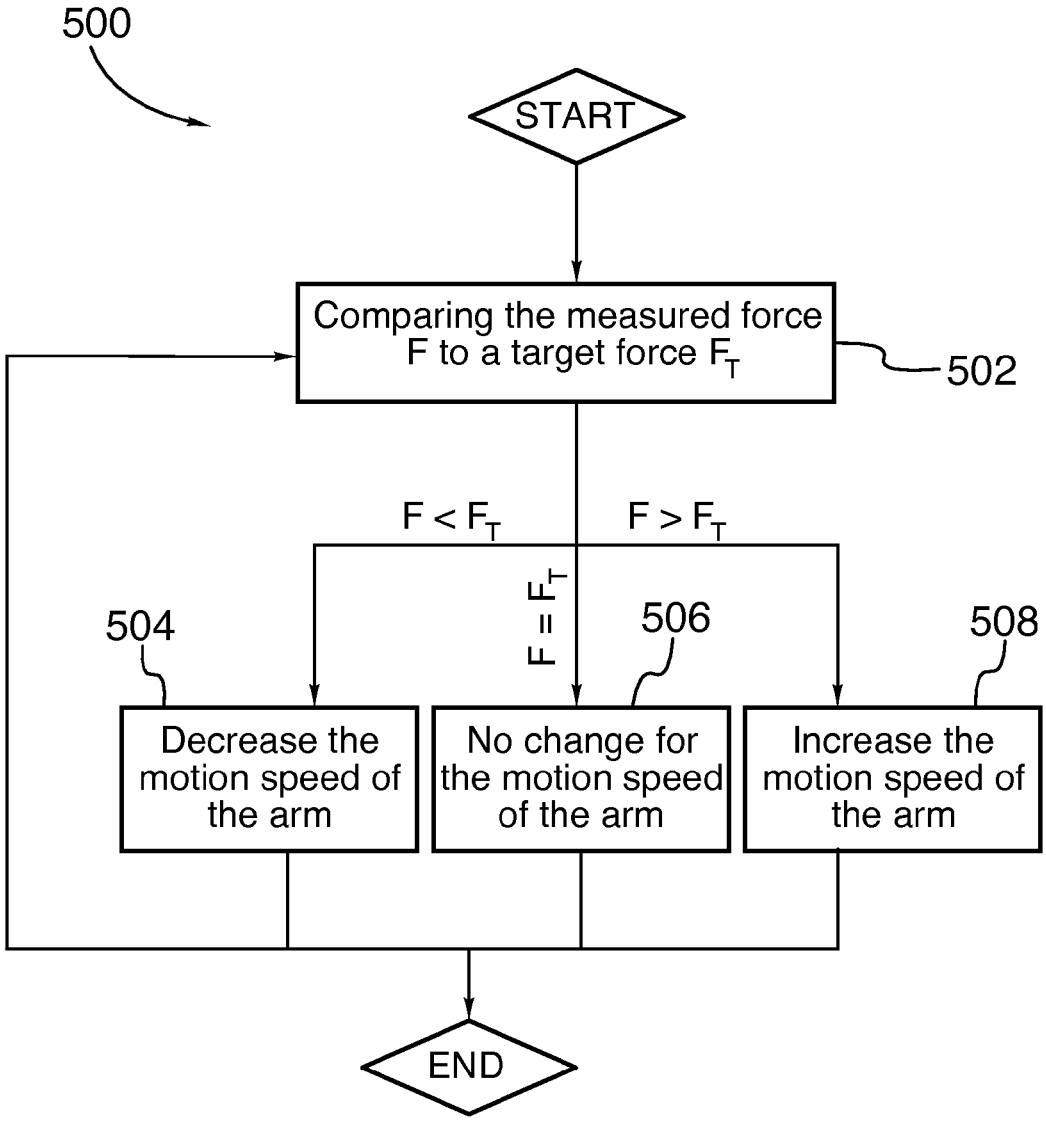
FIG. 13 is a flow chart of a method for varying the speed of an arm of the exercise machine shown in FIG. 1 in response to a force exerted by a user on the handle of the arm, in accordance with one embodiment.

FIG. 13 shows details of the control of the rotational motor speed. When the control unit 20 adjusts the rotational speed of the motors 26, the user experiences the slowing down of the arms 24 as an increase of the weight of the arm 24 and reacts by increasing the force F that he exerts on the handles 30. If the measured force F, when compared to the target force $F_T$ in step 502, is substantially equal to the target force $F_T$, then no change in the rotational speed of the corresponding arm 24 is performed, in accordance with step 506. If the measured force F is superior to the target force T, the control unit 18 increases the rotational speed of the corresponding arm 24 at step 508. The user experiences the acceleration of the arms 24 as a decrease of the weight of the arm 24 and reacts by decreasing the force that he exerts on the handle 30. If the measured force F is inferior to the target force $F_T$, the control unit 20 decreases the rotational speed of the corresponding arm 24 at step 504.

In one embodiment, the control unit 20 does not vary the rotational speed of the arms 24 when the measured force F is comprised between $F_T-\Delta T$ and $F_T+\Delta T$, where $\Delta T$ is a tolerance on the target force $F_T$. In this case, the control unit 18 increases the speed of the arms 24 when the measured force F is inferior to $F_T-\Delta T$, and increases the speed of the arm 24 when the measured force is superior to $F_T+\Delta T$.

In one embodiment, the initial threshold $T_{in}$ and/or the target force $F_T$ are identical for both arms 24. In another embodiment, each arm 24 is associated with a unique initial threshold $T_{in}$ and/or target force $F_T$.

In one embodiment, the initial threshold $T_{in}$ and/or the target force $F_T$ are identical for both a pushing force and a pulling force. In another embodiment, a first initial threshold $T_{in1}$ and/or a first target force $F_{T1}$ is associated with the pushing force and a second initial threshold $T_{in2}$ and/or a second target force $F_{T2}$ is associated with the pulling force.

It will further be appreciated that the corrected rotational speed may be calculated in various manners. In one embodiment where the control unit 20 determines that the measured force F is inferior to the target force $F_T$, the control unit 20 determines the new rotational speed for the arms 24 in accordance with the following equation:

$$V^* = V - \frac{|F - F_T| \cdot \Delta t}{m} \quad \text{(Equation 4)}$$

where V* is the new rotational speed for the arms 24 after the adjustment, V is the actual rotational speed of the arms 24 before the speed adjustment, $\Delta t$ is the time interval or increment between two consecutive measurements of the force exerted by the user and/or between two consecutive determination of the rotational speed by the control unit 20, and m is the simulated mass. In one embodiment, the simulated mass m is the mass corresponding to the target force and is determined as a function of the target force $F_T$.

In another embodiment where the control unit 20 determines that the measured force F is inferior to the target force $F_T$, the control unit 20 determines the new rotational speed for the arm 24 in accordance with the following equation:

$$V^* = V - |F - F_T| \cdot C_1 \quad \text{(Equation 5)}$$

where "V*" is the new rotational speed for the arms 24 after the adjustment, "V" is the actual rotational speed of the arms 24 before the speed adjustment, and "$C_1$" is a correction coefficient. The correction coefficient $C_1$ is chosen so that the slowing down of the arms 24 is faster than the slowing down that would be obtained using equation 4.

In one embodiment where the control unit 18 determines that the measured force F is superior to the target force T, the control unit 18 determines the new rotational speed for the arm 24 in accordance with the following equation:

$$V^* = V + \frac{|F - F_T| \cdot \Delta t}{m} \quad \text{(Equation 6)}$$

where "V*" is the new rotational speed for the arms 24 after the adjustment, "V" is the actual rotational speed of the arms 24 before the speed adjustment, "$\Delta t$" is the time interval between two consecutive measurements of the force exerted by the user and/or between two consecutive determination of the rotational speed by the control unit 20, and "m" is the simulated mass.

In another embodiment where the control unit 20 determines that the measured force F is superior to the target force $F_T$, the control unit 20 determines the new rotational speed for the arm 24 in accordance with the following equation:

$$V^* = V + |F - F_T| \cdot C_2 \quad \text{(Equation 7)}$$

where "V*" is the new rotational speed for the arms 24 after the adjustment, "V" is the actual rotational speed of the arms 24 before the speed adjustment, and "$C_2$" is a correction coefficient. The correction coefficient $C_2$ is chosen so that the acceleration of the arms 24 is faster than that the acceleration that would be obtained using equation 6.

In one embodiment, the correction coefficients $C_1$, $C_2$ each vary as a function of $\Delta t$. It should be understood that the correction coefficients $C_1$ and $C_2$ may be identical or different.

In one embodiment where the correction coefficients $C_1$, $C_2$ are used for determining the rotational speed of the arms 24, the determined speed V* substantially ensures that the user will not exert a force superior to the target force $F_T$. For example, for a time interval $\Delta t$ equal to 13 ms, a force differential $|F-F_T|$ equal to 12 N, and a correction coefficient $C_2$ of 0.007136 rev/N·s, the new rotational speed V* for the arms 24 determined in accordance with equation 7 is equal to 0.08561 rev/s while the new rotational speed V* determined in accordance with equation 6 is equal to 0.004 rev/s. The use of equation 7 allows for a higher new rotational speed with respect to that determined using equation 6, and therefore the charge experienced by the user when equation 7 is used is lower than that experienced when equation 6 is used since the charge experienced by the user decreases with the increase of the rotational speed. Therefore, the risk of exceeding the target force $F_T$ is reduced, thereby reducing the risk of injury.

Figure 14:
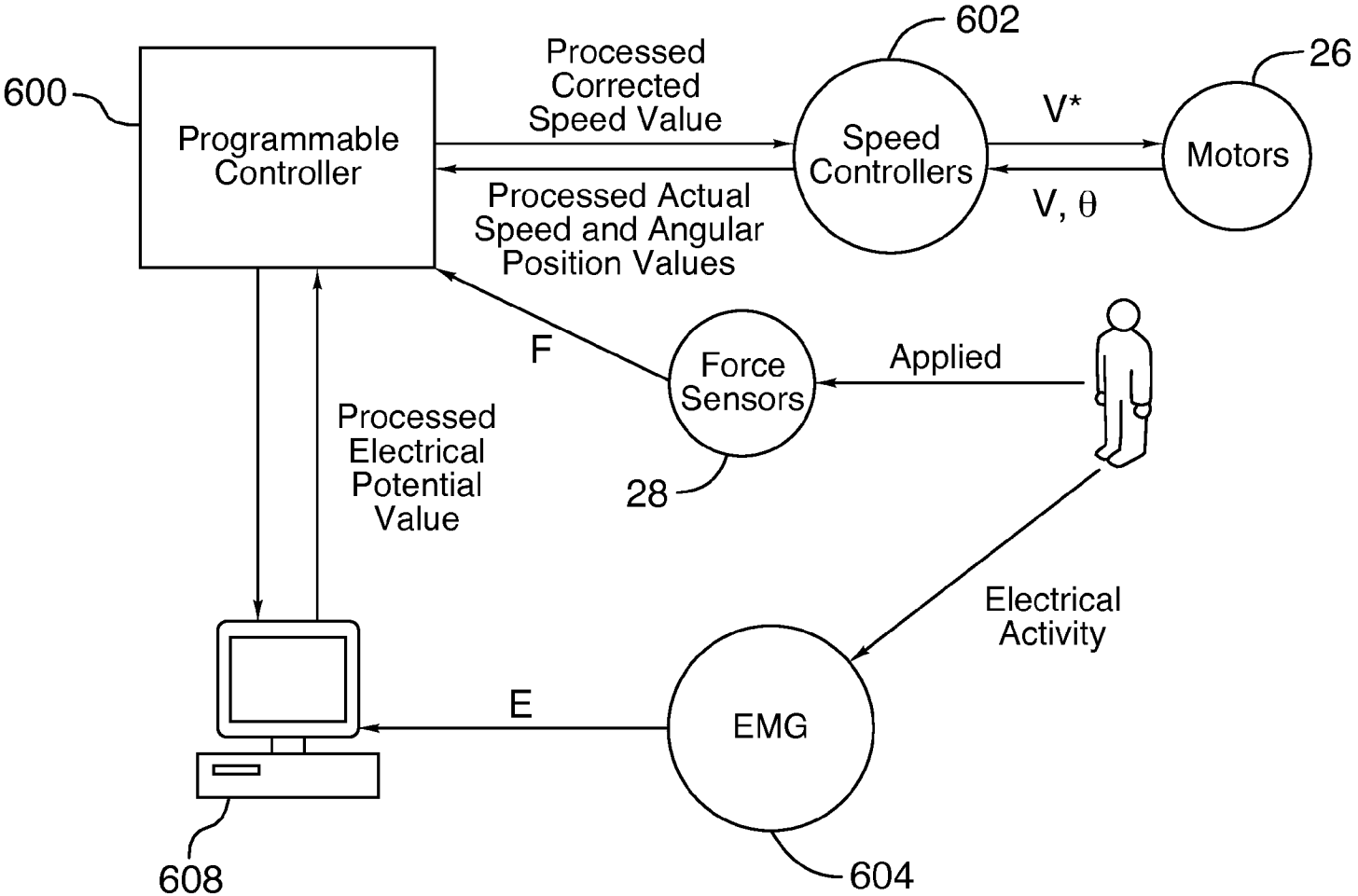
FIG. 14 is a schematic drawing of a system for exercising using muscle feedback.

FIG. 14 shows a system adapted for exercising a muscle of the user using the above-described exercise machine 10, in accordance with one embodiment.

In this embodiment, the control unit 20 comprises a programmable controller 600, programmed according to one or more of the above-described methods. The programmable controller 600 is operatively connected to the force sensors 28 mounted on the arms 24 to allow the force F exerted by the user on the arms 24 to be measured by the force sensors 28 and to be communicated to the programmable controller 600.

In one embodiment, the programmable controller 600 is a programmable automation controller, or PAC, such as a CompactLogix L43™ controller manufactured by Rockwell Automation (Milwaukee, Wis., USA). Alternatively, the programmable controller 600 may instead be a programmable logic controller, or PLC.

The control unit 20 further comprises two speed controllers 602 operatively connected to the programmable controller 600. Each one of the speed controllers 602 is operatively connected to one of the motors 26 for controlling the speed of the motors 26 and thereby the rotational speed of the arms 24 according to the rotational speed V* communicated by the programmable controller 600, as it will become apparent below.

In one embodiment, the speed controllers 602 are servo drives adapted for controlling servo-motors, such as the Allen-Bradley Ultra3000™ servo drives manufactured by Rockwell Automation (Milwaukee, Wis., USA).

In the illustrated embodiment, the speed controllers 602 are further adapted to measure the actual rotational speed V of the arms 24 and to communicate the measured rotational speed V to the programmable controller 600.

This configuration allows the programmable controller 600 to calculate the rotational speed V* of the arms 24 according to the force F exerted by the user on the arms 24, in accordance with one of equations 5 to 7 for instance. The calculated rotational speed V* is then communicated to the speed controllers 602, which set the motors 26 at the calculated rotational speed V*.

Alternatively, the control unit 20 may instead comprise a separate speed sensor operatively connected to the motor and to the programmable controller 600 for measuring the actual rotational speed V of the arms 24.

In the illustrated embodiment, the EMG, indicated at reference numeral 604, is distinct from the programmable controller 600 and operatively connected thereto. Specifically, the EMG 604 comprises the electrodes 32 and a data acquisition system, not shown, operatively connected to the electrodes 32. The data acquisition system is independent from the programmable controller 600 and is operatively connected thereto.

Still in the illustrated embodiment, the control unit 20 is further connected to a computer 608, which is operatively connected to the programmable controller 600. The computer may be provided with a display to allow a technician and/or the user to view the measured electrical potential E during the exercising session. The computer 608 may also receive the measured rotational speed V and the calculated rotational speed V* from the programmable controller 600. The data received in the computer 608 may be used to produce various outputs related to the exercising session such as graphs or charts. The computer 608 may further be used for storing data measured during the exercising session and for comparing the data measured during an exercising session with the data measured during a previous exercising session in order to assess the progress of the user.

In one embodiment, the speed controllers 602 are further adapted to measure the angular position θ of the arm 24 and to communicate the measured angular position θ of the arm 24. This allows the arm 24 to be positioned to its initial angular position $\theta_i$ according to sub-step 204 of method 200 described above.

It should be understood that the frame 12 may have any adequate shape and dimensions, and may be made of any adequate material. For example, the frame 12 may be made from steel or aluminum such as aluminum 6061-T6, for example. In one embodiment, the arms 24 are 36 inches long and have a cross-section measuring 2 inches by 2 inches, or 5.08 centimeters by 5.08 centimeters. While the frame 12 illustrated in FIG. 1 is large enough to comprise a seat 14, it should be understood that the frame 12 may be small enough to be portable. For example, the frame can be attachable to the torso of the user.

While the present description refers to an arm rotatably secured to the frame in order to exercise a shoulder, it should be understood that the exercise machine may comprise any adequate type of bar, lever, or the like adapted to exercise, rehabilitate, or train any body part. The arm, bar, lever, or the like may comprise at least one substantially rigid segment. When the arm, bar, lever, or the like comprises at least two segments, the segments may be fixedly, slidably or jointably connected together and one of the segments is movably secured to the frame.

For example, the arm, bar, lever, or the like may comprise a single segment slidably attached to the frame and the exercise machine is adapted to rehabilitate an injured leg of a user. A force sensor is secured to the single segment of the arm, bar, lever, or the like, and adapted to measure a pushing force exerted by the foot of the user. When the user pushes on the segment of the arm, bar, lever, or the like, the segment slides with respect to the frame.

It should be understood that the arm, bar, lever, or the like may have any adequate motion with respect to the frame so that the user exerts any adequate type of force on the arm, bar, lever, or the like in order to exercise any part of the musculoskeletal system. Examples of an adequate motion for the arm, bar, lever, or the like comprise as a rotational motion, an elliptical motion, a linear motion, and the like. Examples of force applied by a user on the arm, bar, lever, or the like comprise a pushing force, a pulling force, a torsion force, and the like. The force sensor is adapted to measure the type of force exerted by the user While the present description refers to a motor for moving the arm, it should be understood that any actuator can be used. For example, the motor may be a servomotor. In another example, the motor may be replaced a hydraulic system of which the position, speed, and motion direction are controlled by the control unit 20.

It should also be understood that any force sensor may be used in the present system. For example, a load cell or a torque cell can be used for measuring the force or the torque, respectively, exerted by the user of the arm of the exercise machine.

In one embodiment, the force sensors 28 are Model 1022™ single-point load cells manufactured by Vishay Precision Group (Malvern, Pa., USA), and are adapted for measuring applied forces corresponding to masses of up to 30 kilograms.

Results from three (3) tests using the exercise machine 10 described herein, using the methods described above, are provided below. Those results are merely provided as examples and are not intended to limit the scope of the invention.

Each test was performed over a predetermined training period, during which a user performed a predetermined number of exercising sessions at a predetermined frequency. A plurality of parameters was measured to monitor the progress of the user from the beginning to the end of the training period.

For each parameter, a target value, appearing in the column "Objective" in the tables below, was first determined. A first value, appearing in the column "Start" in the tables below, was measured during the first exercising session, at the beginning of the training period. A second value, appearing in the column "End" in the tables below, was then measured during the last exercising session, at the end of the training period. The first and second values were then compared and the change between the first and second value appears in the column "Observations" in the tables below, expressed as a percentage of increase or decrease.

The parameter "angle" corresponds to the angle of movement of the arms at which the exercise machine 10 started compensating for the user because the measured electrical potential exceeded the maximum allowable electrical potential $E_{max}$. In other words, when the user, during an exercising session, moved the arms 24 from a starting position to the indicated angle, the measured electrical potential E was below the calculated maximum allowable electrical potential $E_{max}$. When the arms 24 reached the indicated angle, the measured electrical potential E exceeded the maximum allowable electrical potential $E_{max}$ and the control unit 20 reacted by lowering the target force $F_T$ according to equations 2 and 3 above. The value of "angle" in the column "Objective" represents a target angle by which the user may move the arms 24 without requiring any compensation from the exercise machine 10.

The parameter "charge" corresponds to the measured force F exerted by the user, expressed in terms of mass, at which the exercise machine started compensating for the user. In other words, this parameters corresponds to the measured force F exerted by the user when the arms 24 were moved at the angle indicated by the parameter "angle", at which the measured electrical potential E exceeded the maximum allowable electrical potential $E_{max}$ and the control unit 20 reacted by lowering the target force $F_T$ according to equations 2 and 3 above. The value of "charge" in the column "Objective" represents a target maximum charge which may be exerted by the user on the arms 24 without requiring any compensation from the exercise machine 10.

The parameter "force" corresponds to the target force $F_T$ which was inputted into the control unit 20 prior to the start of the exercising session. The value of "force" in the column "Start" represents the target force $F_T$ which was inputted prior to the start of the first exercising session performed by the user at the beginning of the training period, and the value of "force" in the column "End" represents the target force $F_T$ which was inputted prior to the start of the last exercising session performed by the user at the end of the training period.

The parameter "average PUMs" corresponds to the average percentage of the measured electrical potential E with respect to the maximum electrical potential measured prior to the start of an exercising session. The value of "average PUMs" in the column "Objective" represents the calculated $E_{max}$, expressed as a percentage of the maximum electrical potential measured prior to the start of an exercising session.

EXAMPLE 1

A special training program was conceived for an injured worker in a rehabilitation context, with the objective of enabling him to return to his full-time position as an electrician.

The special training program was centered on exercising sessions, three times a week, for a period of eight (8) weeks. During the same period, the patient also participated in aerobics training, monitored weight training and stretching exercises.

The training on the exercise machine was specially tailored to correspond to real work situations which required some efforts from the patient, particularly from his upper body. The target force $F_T$ used and the angle of the movements were selected according to tasks specific to his field. The training plan consisted of arm flexions and arm extensions. At each exercising session, twenty-four (24) repetitions of each movement were done.

The training was mainly focused on the left latissimus dorsi muscle and the right latissimus dorsi muscle.

The results from this test is shown in the following tables:

TABLE I

| Right Latissimus Dorsi Muscle | | | | |
|---|---|---|---|---|
| Parameter | Objective | Start | End | Observations |
| Angle | 135 degrees of total arms movement | Compensation starting at 16 degrees | No compensation required | 90% improvement |
| Charge | 3 kg | Compensation starting at 1.57 kg | No compensation required | 48% improvement |
| Force | None | 14 kg | 18.7 kg | 25% improvement |
| Average PUMs | 30% | 49% | 23% | 26% improvement |

TABLE II

| Left Latissimus Dorsi Muscle | | | | |
|---|---|---|---|---|
| Parameter | Objective | Start | End | Observations |
| Angle | 135 degrees of total arms movement | Compensation starting at 38 degrees | No compensation required | 72% improvement |

TABLE II-continued

| Left Latissimus Dorsi Muscle | | | | |
|---|---|---|---|---|
| Parameter | Objective | Start | End | Observations |
| Charge | 3 kg | Compensation starting at 0.61 kg | No compensation required | 80% improvement |
| Force | None | 14 kg | 19.6 kg | 29% improvement |
| Average PUMs | 30% | 67% | Less than 30% | >50% improvement |

It will readily be appreciated by the skilled addressee that these increases (between 25% and 90%) are substantial. All objectives were met by the worker.

EXAMPLE 2

A special training program was conceived for a worker with an injury to his right shoulder in a rehabilitation context, with the objective of enabling him to return to a full-time position as a construction worker.

The special training program was centered on exercising sessions, three times a week, for a period of six (6) weeks. During the same period, the patient also participated in aerobics training, monitored weight training and stretching exercises.

The training on the exercise machine was specially tailored to correspond to real work situations which required some efforts from the patient, particularly from his upper body. The target force $F_T$ used and the angle of the movements were selected according to tasks specific to his field. The training plan consisted of arm flexions, arm extensions, arm abductions and arm adductions. At each exercising session, forty (40) repetitions of each movement were done.

The training was mainly focused on the left anterior deltoid muscle, the left middle deltoid muscle, the right anterior deltoid muscle and the right middle anterior muscle.

The results from this test is shown in the following tables:

TABLE III

| Right Anterior Deltoid Muscle | | | | |
|---|---|---|---|---|
| Parameter | Objective | Start | End | Observations |
| Angle | 95 degrees of total arms movement | Compensation starting at 40 degrees | No compensation required | 44% improvement |
| Charge | 2 kg | Compensation starting at 1.07 kg | No compensation required | 25% improvement |
| Force | None | 5.5 kg | 8.1 kg | 47% improvement |
| Average PUMs | 30% | 91% | 45% | 51% improvement |

TABLE IV

| Right Middle Deltoid Muscle | | | | |
|---|---|---|---|---|
| Parameter | Objective | Start | End | Observations |
| Angle | 45 degrees of total arms movement | Compensation starting at 20 degrees | Compensation starting at 22 degrees | 9% improvement |
| Charge | 2 kg | Compensation starting at 1.05 kg | Compensation starting at 1.04 kg | Substantially similar |
| Average PUMs | 30% | 134% | 78% | 56% improvement |

TABLE V

| Left Anterior Deltoid Muscle | | | | |
|---|---|---|---|---|
| Parameter | Objective | Start | End | Observations |
| Angle | 90 degrees of total arms movement | Compensation starting at 38 degrees | Compensation starting at 48 degrees | 21% improvement |
| Charge | 2 kg | Compensation starting at 1.6 kg | Compensation starting at 1.6 kg | Substantially similar |
| Average PUMs | 30% | 76% | 73% | 3% improvement |

TABLE VI

| Left Middle Deltoid Muscle | | | | |
|---|---|---|---|---|
| Parameter | Objective | Start | End | Observations |
| Angle | 95 degrees of total arms movement | Compensation starting at 39 degrees | Compensation starting at 44 degrees | 11% improvement |
| Charge | 2 kg | Compensation starting at 1.52 kg | Compensation starting at 1.62 kg | 6% improvement |
| Average PUMs | 30% | 134% | 78% | 56% improvement |

It will readily be appreciated by the skilled addressee that these increases (between 0% and 56%) are substantial.

We further note that the improvements of the right anterior and middle deltoid muscles are generally higher than the improvement of the left anterior and middle deltoid muscles. It appears that in this case, the exercise machine 10 was particularly beneficial to the right arm and shoulder, which was the injured shoulder, and therefore that in some conditions, the exercise machine 10 described herein may be used to rehabilitate an injured member with surprisingly great results.

EXAMPLE 3

A special training program was conceived for an injured worker in a rehabilitation context, with the objective of enabling him to return to his full-time position as a carpenter.

The special training program was centered on exercising sessions, three times a week, for a period of eight (8) weeks. During the same period, the patient also participated in aerobics training, monitored weight training and stretching exercises.

The training on the exercise machine was specially tailored to correspond to real work situations which required some efforts from the patient, particularly from his upper body. The target force $F_T$ used and the angle of the movements were selected according to tasks specific to his field. The training plan consisted of arm flexions, arm extensions, arm abductions and arm adductions. At each exercising session, forty (40) repetitions of each movement were done.

The training was mainly focused on the left anterior deltoid muscle, the left middle deltoid muscle, the right anterior deltoid muscle and the right middle anterior muscle.

The results from this test is shown in the following tables:

TABLE VII

| Right Middle Deltoid Muscle | | | | |
|---|---|---|---|---|
| Parameter | Objective | Start | End | Observations |
| Angle | 95 degrees of total arms movement | Compensation starting at 60 degrees | Compensation starting at 75 degrees | 20% improvement |
| Charge | 2 kg | Compensation starting at 0.96 kg | Compensation starting at 0.86 kg | 21% improvement |
| Force | None | 10.6 kg | 16 kg | 51% improvement |
| Average PUMs | 30% | 54% | 47% | 7% improvement |

TABLE VIII

| Right Anterior Deltoid Muscle | | | | |
|---|---|---|---|---|
| Parameter | Objective | Start | End | Observations |
| Angle | 95 degrees of total arms movement | Compensation starting at 50 degrees | Compensation starting at 46 degrees | 8% decrease |
| Charge | 5 kg | Compensation starting at 0.24 kg (with a 2 kg charge) | Compensation starting at 3.04 kg (with a 5 kg charge) | Substantial improvement |
| Force | None | 18 kg | 20 kg | 11% improvement |
| Average PUMs | 30% | 216% | 81% | 135% improvement |

TABLE IX

| Left Middle Deltoid Muscle | | | | |
|---|---|---|---|---|
| Parameter | Objective | Start | End | Observations |
| Angle | 45 degrees of total arms movement | Compensation starting at 25 degrees | Compensation starting at 28 degrees | 11% improvement |
| Charge | 2 kg | Compensation starting at 1.1 kg | Compensation starting at 0.11 kg | 90% improvement |
| Force | None | 6.7 kg | 3.7 kg | 45% decrease |
| Average PUMs | 30% | 99% | 45% | 54% improvement |

TABLE X

| Left Anterior Deltoid Muscle | | | | |
|---|---|---|---|---|
| Parameter | Objective | Start | End | Observations |
| Angle | 95 degrees of total arms movement | Compensation starting at 31 degrees | Compensation starting at 56 degrees | 45% improvement |
| Charge | 2 kg | Compensation starting at 1.62 kg | Compensation starting at 0.62 kg | 42% improvement |
| Force | None | 6.7 kg | 5.6 kg | 15% decrease |
| Average PUMs | 30% | 183% | 85% | 98% improvement |

It will readily be appreciated by the skilled addressee that these improvements are substantial, especially in terms of endurance, which is defined mainly by the "angle", "charge" and "average PUMs" parameters, although in some instances, the worker appears to have lost some force in those muscles from the first exercising session to the last exercising session.

Generally, those results show that in some conditions, the exercise machine 10 described herein provides substantial improvements to muscles exercised using the machine, particularly in terms of endurance and particularly in a rehabilitation context.

It should be noted that the present invention can be carried out as a method or can be embodied in a system or an apparatus. The embodiments of the invention described above are intended to be exemplary only. The scope of the invention is therefore intended to be limited solely by the scope of the appended claims.

We claim:

1. A method for operating an exercise machine, said method comprising:

measuring a force exerted by a user on an arm movably secured to a frame of said exercise machine via an actuator;

comparing said force to a maximum limit;

when said force is inferior or equal to a target force, determining a displacement speed for said arm in accordance with said force;

moving said arm in accordance with said displacement speed; and when said force is superior to said target force, increasing said displacement speed of said arm via said actuator.

2. The method as claimed in claim 1, further comprising:

measuring an electrical potential generated by a muscle of said user while said user is moving said arm; and when said electrical potential is superior to a maximum allowable electrical potential, decreasing said target force.

3. The method as claimed in claim 2, further comprising, before measuring the force exerted by said user on said arm:

measuring a maximum electrical potential generated by said muscle of said user; and calculating the maximum allowable electrical potential according to said maximum electrical potential.

4. The method as claimed in claim 3, wherein measuring said maximum electrical potential comprises:

blocking said arm so as to prevent movement thereof; and measuring the electrical potential generated by said muscle when said user exerts a maximum amount of force against said arm.

5. The method as claimed in claim 2, wherein decreasing said target force comprises:

calculating a potential difference between said electrical potential generated by a muscle of said user and said maximum allowable electrical potential;

calculating a potential difference ratio of said potential difference with respect to said maximum allowable electrical potential;

applying said potential difference ratio to said target force to obtain a force correction value; and subtracting said target force by said force correction value.

6. The method as claimed in claim 1, wherein determining a displacement speed for said arm comprises:

measuring an actual displacement speed;

calculating a force difference between the force exerted by the user on the arm and the target force;

applying a predetermined correction coefficient to said force difference to obtain a correction value; and subtracting said correction value from said actual displacement speed to obtain a corrected displacement speed.

7. The method as claimed in claim 1, wherein increasing said displacement speed of said arm comprises:

measuring an actual displacement speed;

calculating a force difference between the force exerted by the user on the arm and the target force;

applying a predetermined correction coefficient to said force difference to obtain a correction value; and adding said correction value to said actual displacement speed to obtain a corrected displacement speed.

8. The method as claimed in claim 1, further comprising allowing for an initial displacement for said arm only when said force is at least equal to a force threshold.

9. The method as claimed in claim 1, further comprising, before measuring the force exerted by said user on said arm, positioning said arm in a predetermined initial angular position.

* * * * *